US012576481B2

(12) United States Patent
Posadas et al.

(10) Patent No.: US 12,576,481 B2
(45) Date of Patent: Mar. 17, 2026

(54) ADJUSTABLE ANGLE ROLLER SHARPENER AND METHOD OF USE

(71) Applicant: Apex Smart Products LLC, San Diego, CA (US)

(72) Inventors: Alex J. Posadas, San Diego, CA (US); Shannon D. Posadas, San Diego, CA (US)

(73) Assignee: Apex Smart Products LLC, San Diego, CA (US)

( * ) Notice: Subject to any disclaimer, the term of this patent is extended or adjusted under 35 U.S.C. 154(b) by 132 days.

(21) Appl. No.: 18/607,304

(22) Filed: Mar. 15, 2024

(65) Prior Publication Data

US 2025/0289095 A1 Sep. 18, 2025

(51) Int. Cl.
*B24D 15/08* (2006.01)

(52) U.S. Cl.
CPC ..... *B24D 15/08* (2013.01)

(58) Field of Classification Search
CPC ..... B24D 15/08; B24D 15/06; B24B 3/54
USPC ..... 76/82, 88; 451/364, 367, 387, 392, 393, 451/368, 369, 370, 371, 378, 380, 523, 451/524, 552, 555, 558, 553, 557
See application file for complete search history.

(56) References Cited

U.S. PATENT DOCUMENTS

| | | | | |
|---|---|---|---|---|
| 1,148,303 | A * | 7/1915 | Farrar | B24D 15/063 76/82.2 |
| 4,216,627 | A * | 8/1980 | Westrom | B24D 15/063 451/175 |
| 5,185,958 | A * | 2/1993 | Dale | B24D 15/06 451/558 |
| 2009/0088053 | A1* | 4/2009 | Hummel | B24B 3/34 451/380 |
| 2022/0088820 | A1* | 3/2022 | Wildman | B27J 1/00 |
| 2023/0108809 | A1 | 4/2023 | Horl | |
| 2023/0294232 | A1* | 9/2023 | Horl | B24B 41/06 451/553 |
| 2023/0405767 | A1* | 12/2023 | Berger | B24D 15/08 |

* cited by examiner

*Primary Examiner* — Phong H Nguyen
(74) *Attorney, Agent, or Firm* — Procopio, Cory, Hargreaves & Savitch LLP

(57) ABSTRACT

A roller sharpener including a blade edge grinding member to sharpen an edge of a blade of a knife comprising a magnetic knife holder configured to hold the blade of the knife at one or more angles; and an adjustable roller sharpener configured to hold the blade edge grinding member at variable heights to sharpen different-sized blades of different knives, the adjustable roller sharpener with grinding member rollable back and forth on a support surface to sharpen the edge of the blade of the knife held to the magnetic knife holder.

14 Claims, 29 Drawing Sheets

ADJUSTABLE ANGLE ROLLER SHARPENER AND METHOD OF USE

BACKGROUND OF THE INVENTION

The present invention generally relates to knife sharpeners.

BRIEF SUMMARY

Implementations of the present disclosure relate to an adjustable angle roller sharpener including an adjustable magnetic knife holder and a rolling knife sharpener configured to provide exceptionally sharp and long-lasting edges on knives or other cutting objects.

An aspect of present disclosure involves a roller sharpener including a blade edge grinding member to sharpen an edge of a blade of a knife comprising a magnetic knife holder configured to hold the blade of the knife at one or more angles; and an adjustable roller sharpener configured to hold the blade edge grinding member at variable heights to sharpen different-sized blades of different knives, the adjustable roller sharpener with grinding member rollable back and forth on a support surface to sharpen the edge of the blade of the knife held to the magnetic knife holder.

One or more implementations of the above aspect of the disclosure include one or more of the following: the magnetic knife holder is an adjustable magnetic knife holder configured to hold the blade of the knife at variable angles; the adjustable magnetic knife holder includes an adjustable angle assembly configured to adjust the held blade of the knife at the variable angles; the adjustable angle assembly includes a rotatable back sharpening angle knob, an adjustable angle member, a knife holder magnet carried by the adjustable angle member and configured to magnetically hold the blade of the knife; the adjustable angle assembly includes a connecting rod, a slider, a lead screw, wherein the knob is rotatable to cause the lead screw to drive the slider to control the adjustable angle member via the connecting rod to adjust the angle of the adjustable angle member, knife holder magnet, and the blade; the adjustable angle assembly includes a torsion spring configured pre-tighten the slider and the connecting rod; the adjustable angle assembly is adjustable to single increments (e.g., 10°, 11°, 12°, etc.) from 10° to 40°; the adjustable roller sharpener includes an adjustable height assembly configured to hold the blade edge grinding member at variable heights to sharpen different-sized blades of different knives; the adjustable height assembly includes a height adjustment member, a plate holder magnet carried by the height adjustment member and configured to magnetically hold the blade edge grinding member; the adjustable roller sharpener includes a vertical support, and the adjustable height assembly includes a thumb knob assembly with a bracket and a rotatable thumb knob, the thumb knob assembly configured to allow vertical adjustment of the height adjustment member relative to the vertical support; the adjustable roller sharpener includes bottom rollers configured to enable the adjustable roller sharpener back and forth on a support surface to sharpen the edge of the blade of the knife held to the magnetic knife holder; the blade edge grinding member includes a kit of different types of blade edge grinding members; the kit of different types of blade edge grinding members include one or more diamond grinding plates and one or more ceramic plates; and/or the kit of different types of blade edge grinding members include a diamond 400 #grinding plate, a diamond 800 #grinding plate, a ceramics 1000 #plate, 3000 #whetstone, and 6000 #whetstone plate.

Another aspect of the disclosure involves a method of using an adjustable angle roller sharpener including a blade edge grinding member to sharpen an edge of a blade of a knife comprising a magnetic knife holder configured to hold the blade of the knife at one or more angles; and an adjustable roller sharpener configured to hold the blade edge grinding member at variable heights to sharpen different-sized blades of different knives, the adjustable roller sharpener with grinding member rollable back and forth on a support surface to sharpen the edge of the blade of the knife held to the magnetic knife holder, the magnetic knife holder is an adjustable magnetic knife holder configured to hold the blade of the knife at variable angles, the adjustable roller sharpener includes an adjustable height assembly configured to hold the blade edge grinding member at variable heights to sharpen different-sized blades of different knives, the method comprising adjusting a sharpening angle of the adjustable angle assembly appropriate to the blade of the knife; magnetically holding the blade of the knife with the adjustable angle assembly; adjusting a height of the adjustable height assembly appropriate to the blade of the knife; magnetically holding the blade edge grinding member with the adjustable height assembly; sharpening the edge of the blade of the knife held to the magnetic knife holder with the blade edge grinding member by rolling the adjustable roller sharpener with grinding member back and forth on a support surface.

One or more implementations of the above aspect of the disclosure include one or more of the following: replacing the blade edge grinding member with a different blade edge grinding member, and sharpening the edge of the blade of the knife held to the magnetic knife holder with the different blade edge grinding member; removing the knife held to the magnetic knife holder, adjusting a sharpening angle of the adjustable angle assembly appropriate to the blade of a different knife; magnetically holding the blade of the different knife with the adjustable angle assembly; and/or adjusting a height of the adjustable height assembly appropriate to the blade of the different knife; magnetically holding the blade edge grinding member with the adjustable height assembly; sharpening the edge of the blade of the different knife held to the magnetic knife holder with the blade edge grinding member by rolling the adjustable roller sharpener with grinding member back and forth on a support surface.

BRIEF DESCRIPTION OF THE DRAWINGS

In order to describe the manner in which the present disclosure can be implemented, a more particular description will be rendered by reference to specific implementations thereof which are illustrated in the appended drawings. For better understanding, the like elements have been designated by like reference numbers throughout the various accompanying figures. Understanding that these drawings depict only typical implementations of the invention and are not therefore to be considered to be limiting of its scope, the invention will be described and explained with additional specificity and detail through the use of the accompanying drawings in which.

DETAILED DESCRIPTION

In this disclosure, as illustrated in FIGS. 1-12, specific terminology is employed for the sake of clarity. The invention as claimed in this application, however, is not intended to be limited to specific terminology so selected, and it is to be understood that each specific element includes all technical equivalents that operate in a similar manner to accomplish similar functions.

Figure 1:
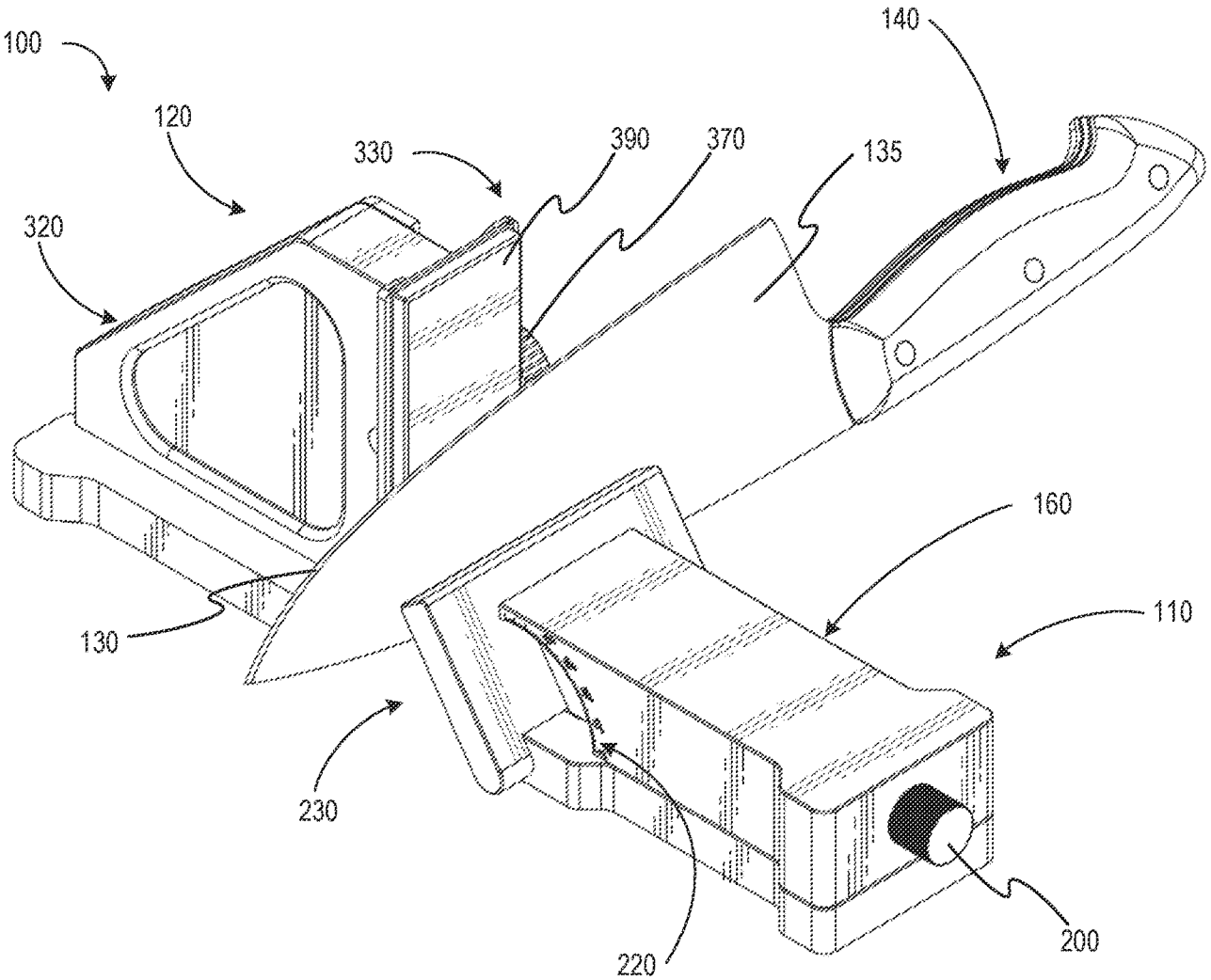
FIG. 1 illustrates a perspective view of an adjustable angle roller sharpener with a knife about to be sharpened according to an implementation of the present disclosure.
Figure 2:
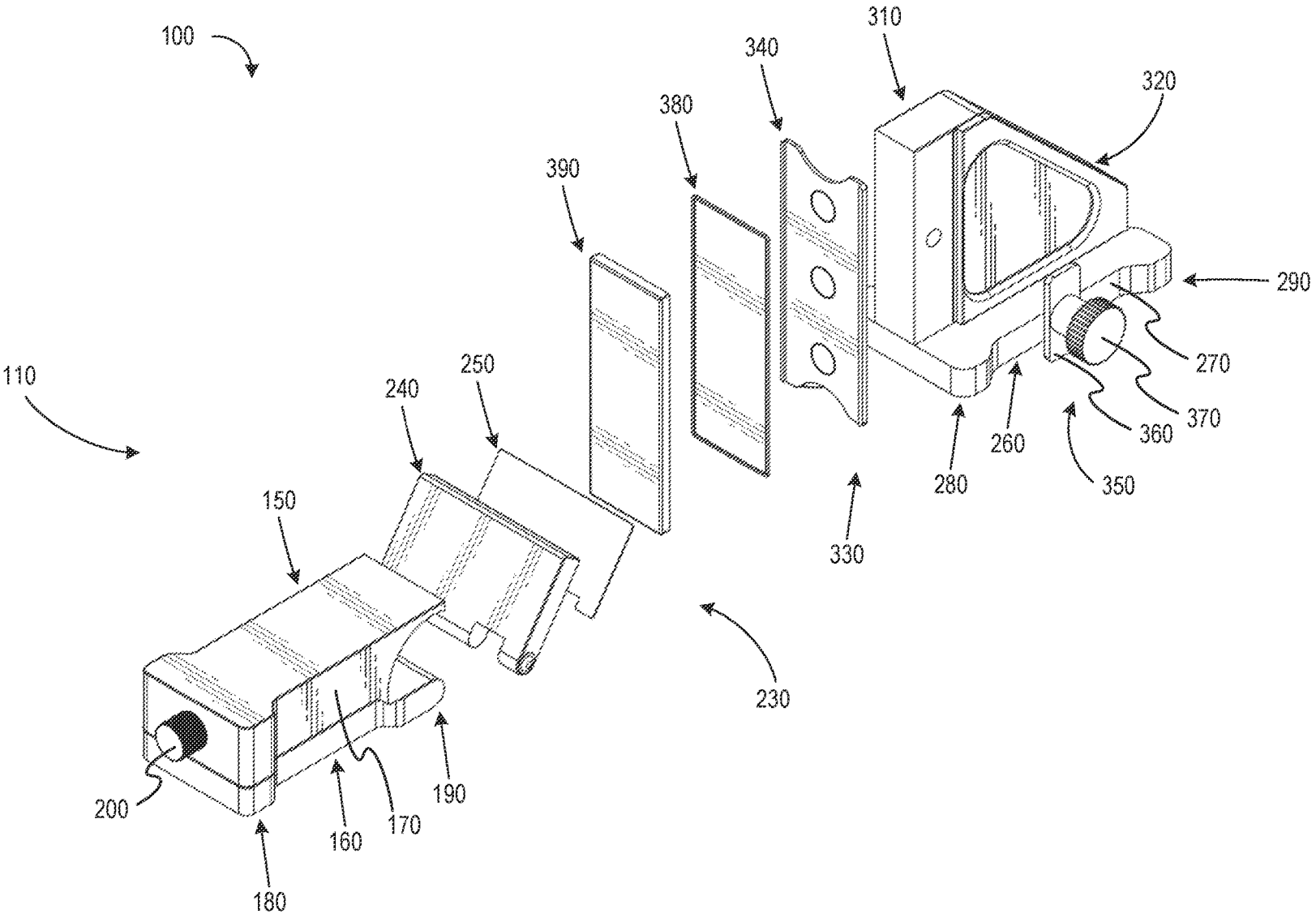
FIG. 2 illustrates an exploded perspective view of the adjustable angle roller sharpener of FIG. 1
Figure 3:
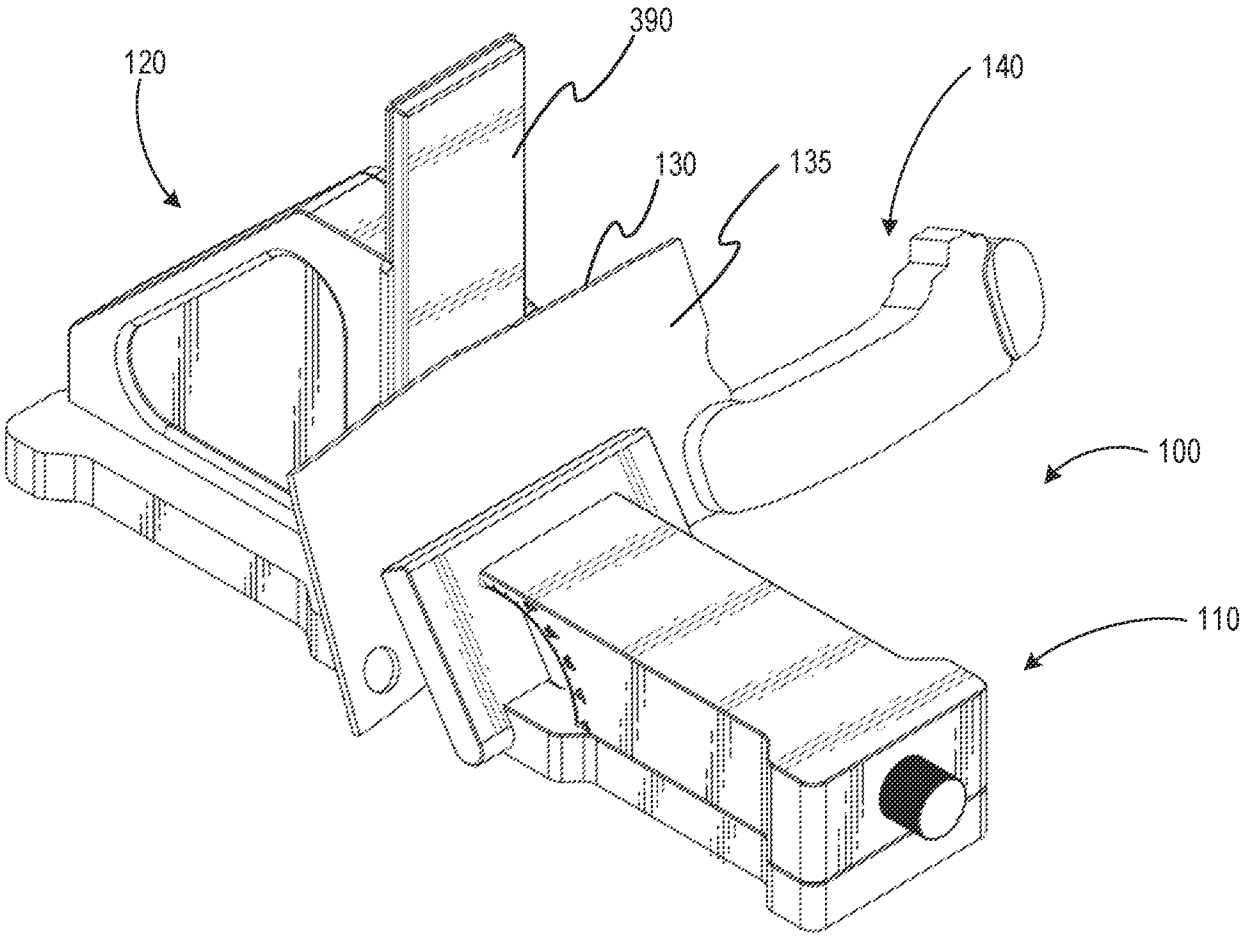
FIG. 3 illustrates a perspective view of the adjustable angle roller sharpener of FIG. 1 in use with a different type of knife than that shown in FIG. 1.
Figure 4:
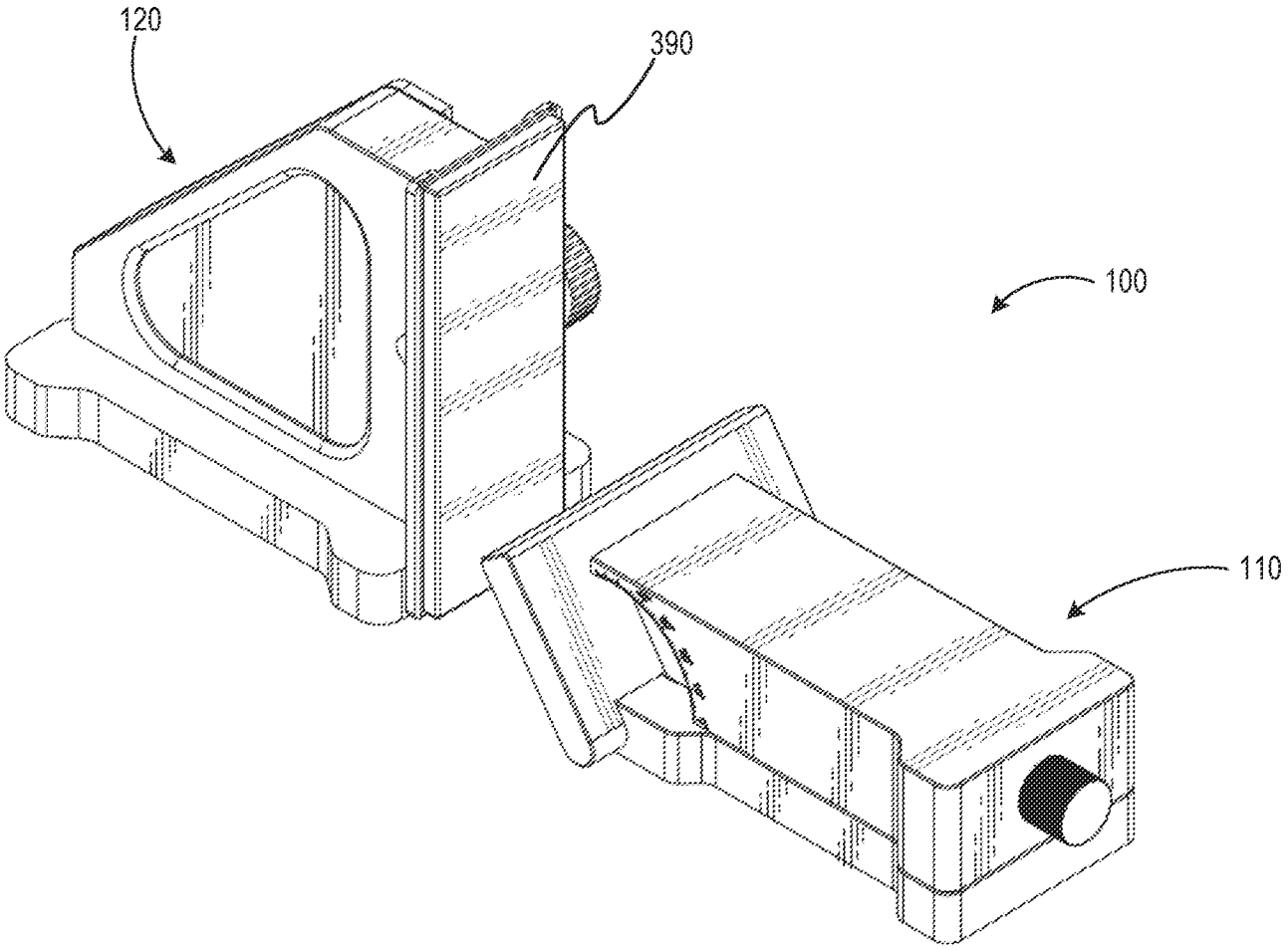
FIG. 4 illustrates a front perspective view of the adjustable angle roller sharpener of FIG. 1 without a knife shown.
Figure 5:
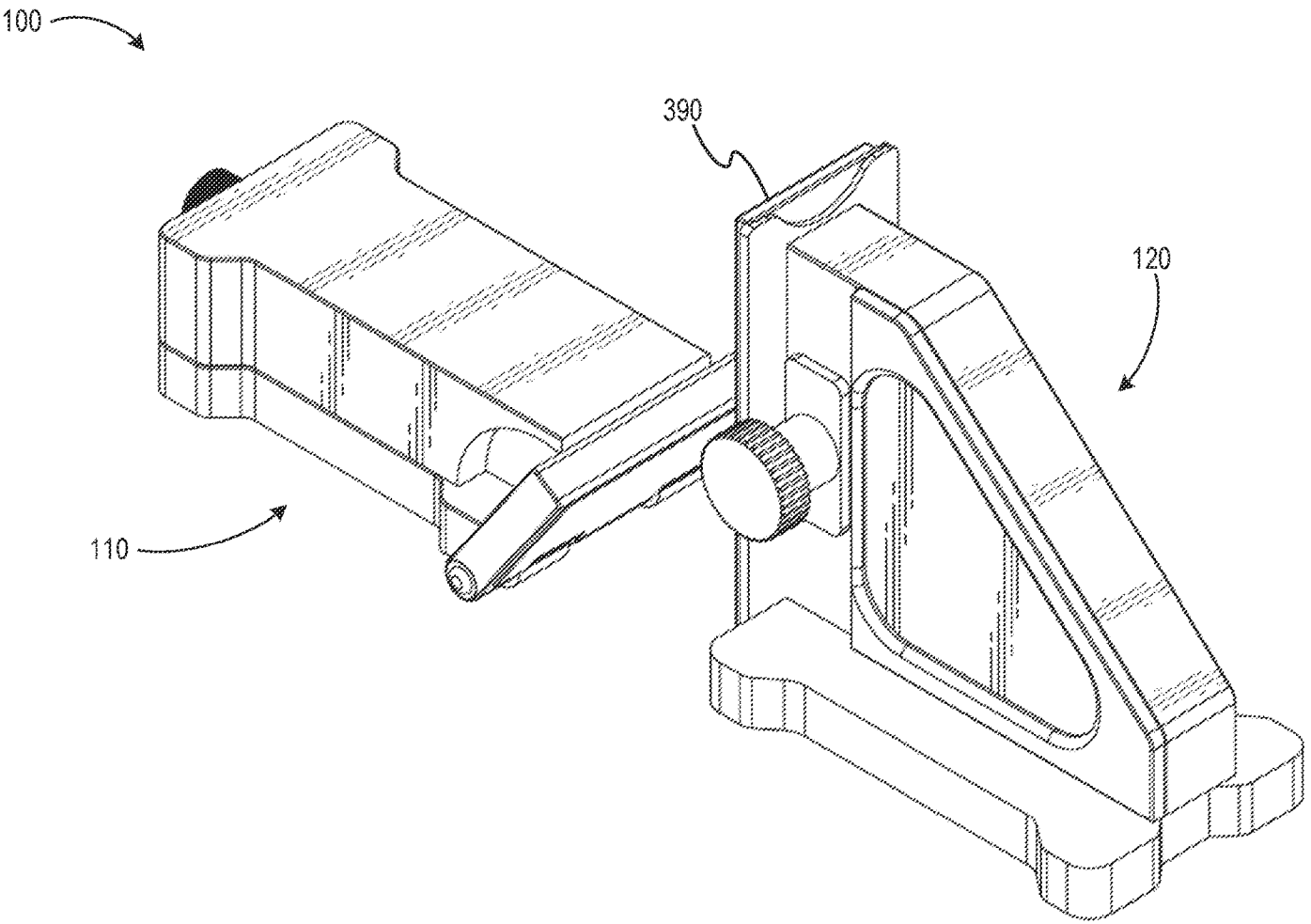
FIG. 5 illustrates a rear perspective view of the adjustable angle roller sharpener of FIG. 4.
Figure 6:
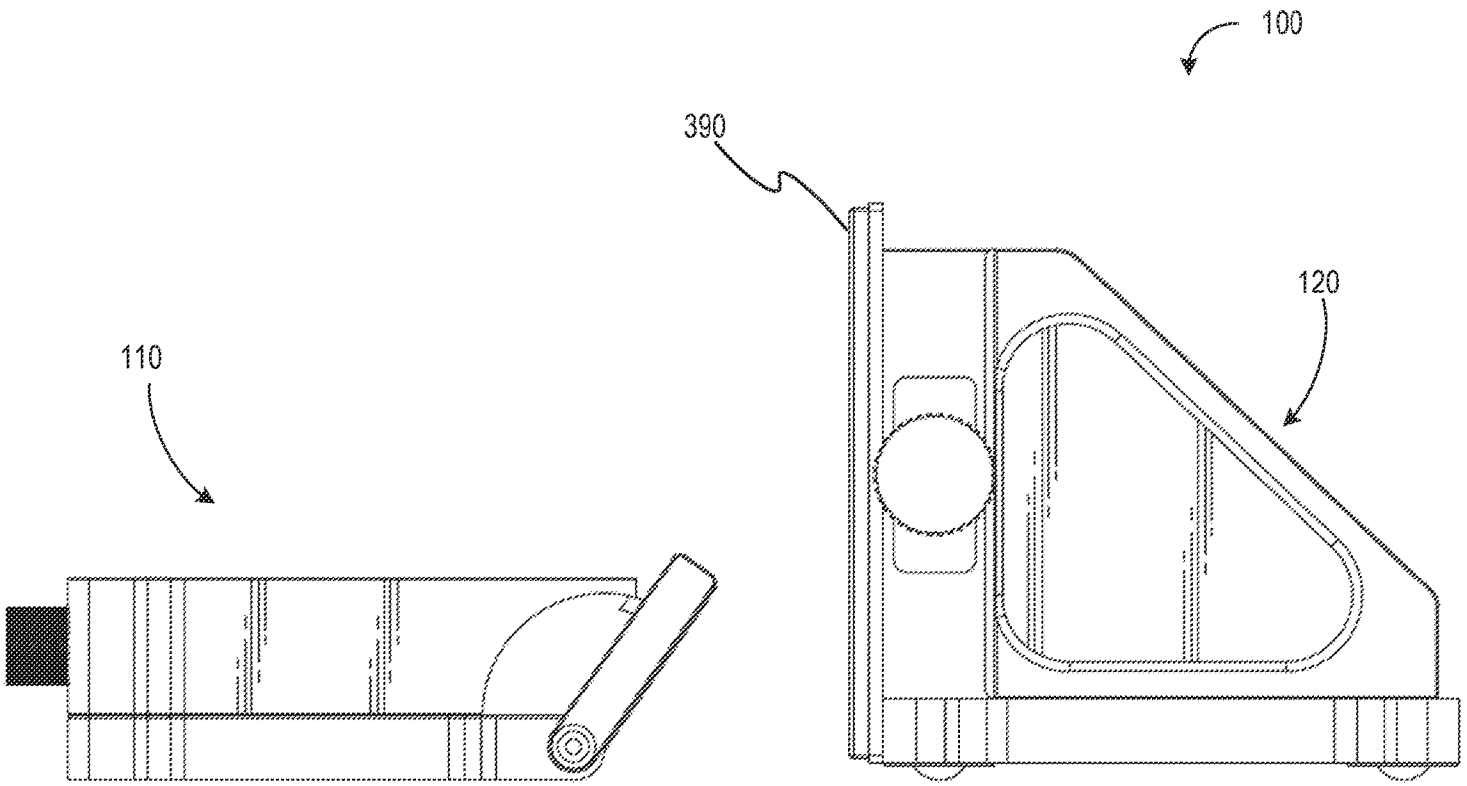
FIG. 6 illustrates a front elevational view of the adjustable angle roller sharpener of FIG. 4.
Figure 7:
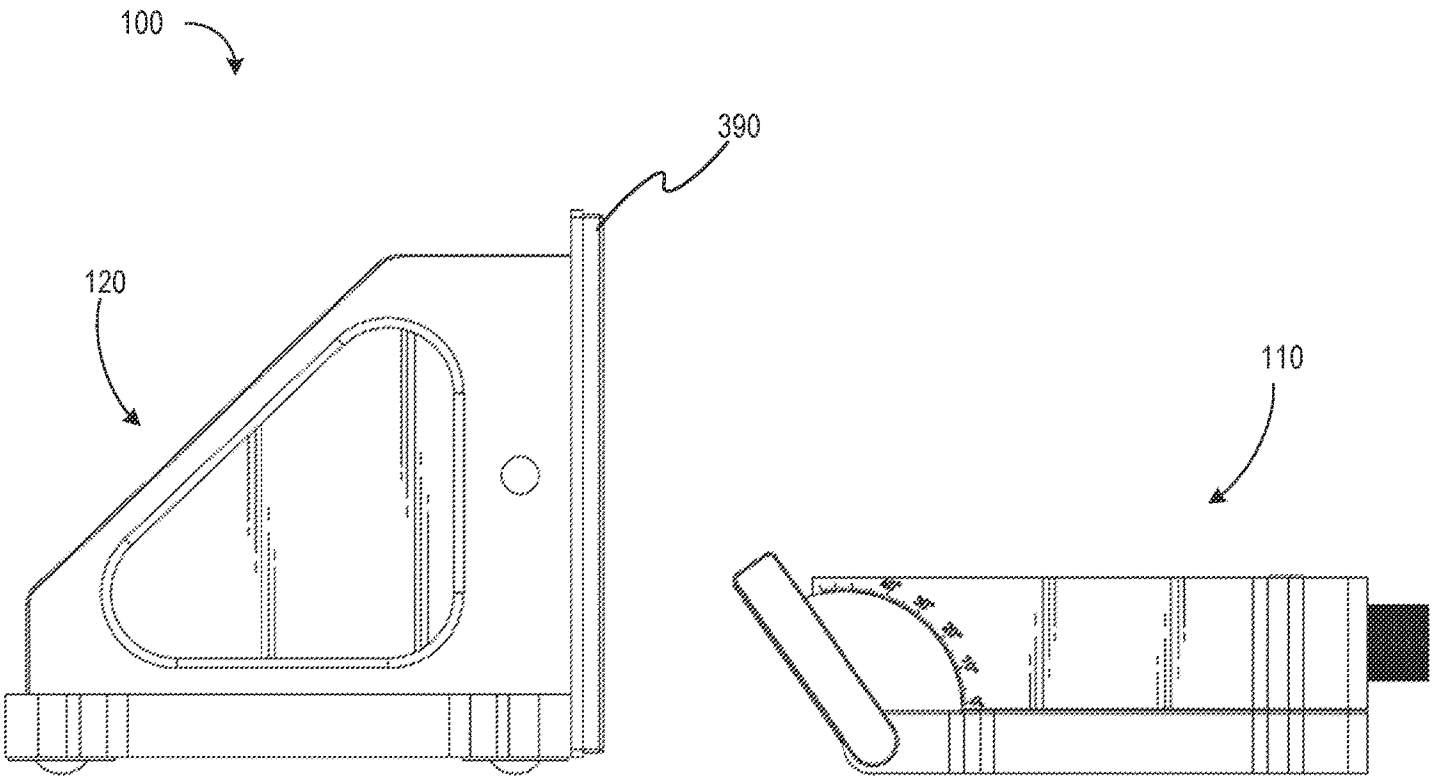
FIG. 7 illustrates a rear elevational view of the adjustable angle roller sharpener of FIG. 4.
Figure 8:
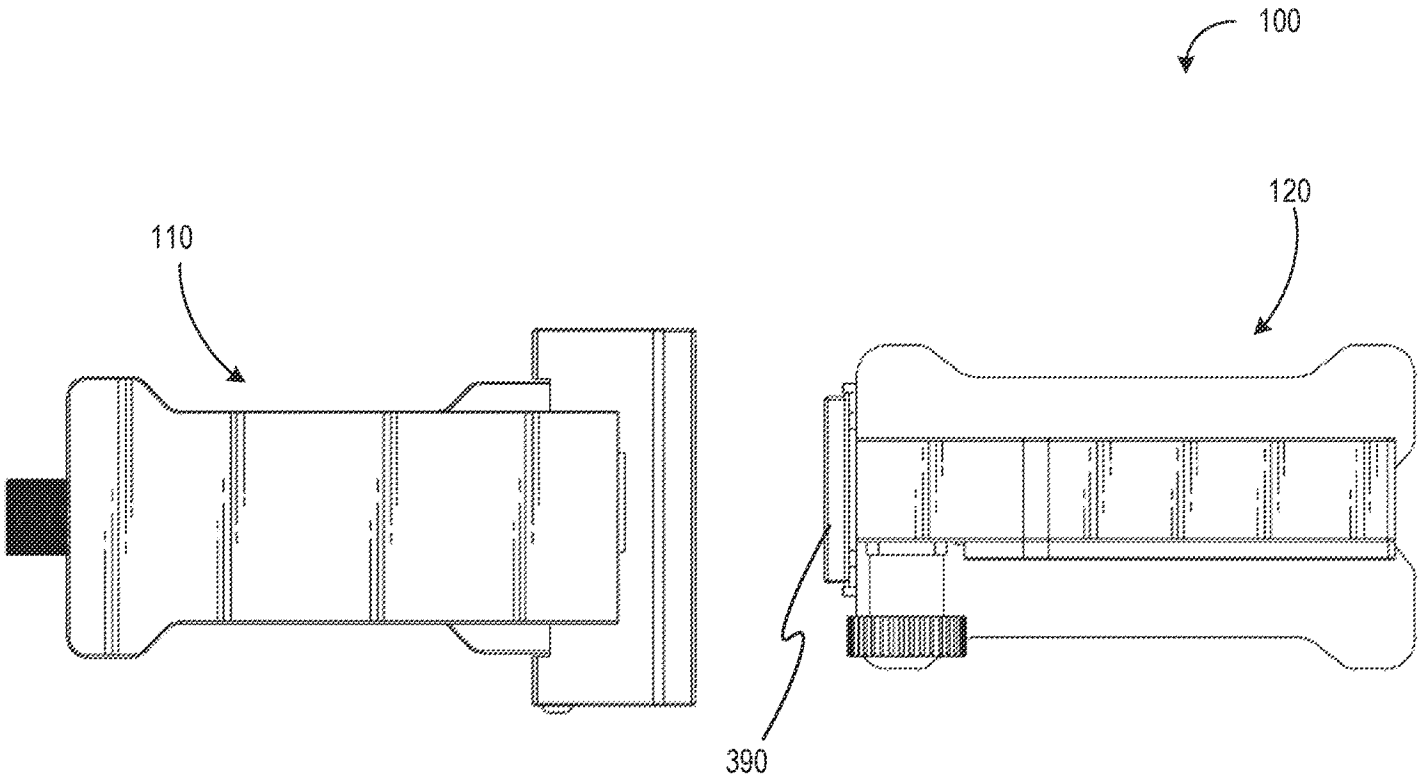
FIG. 8 illustrates a top plan view of the adjustable angle roller sharpener of FIG. 4.
Figure 9:
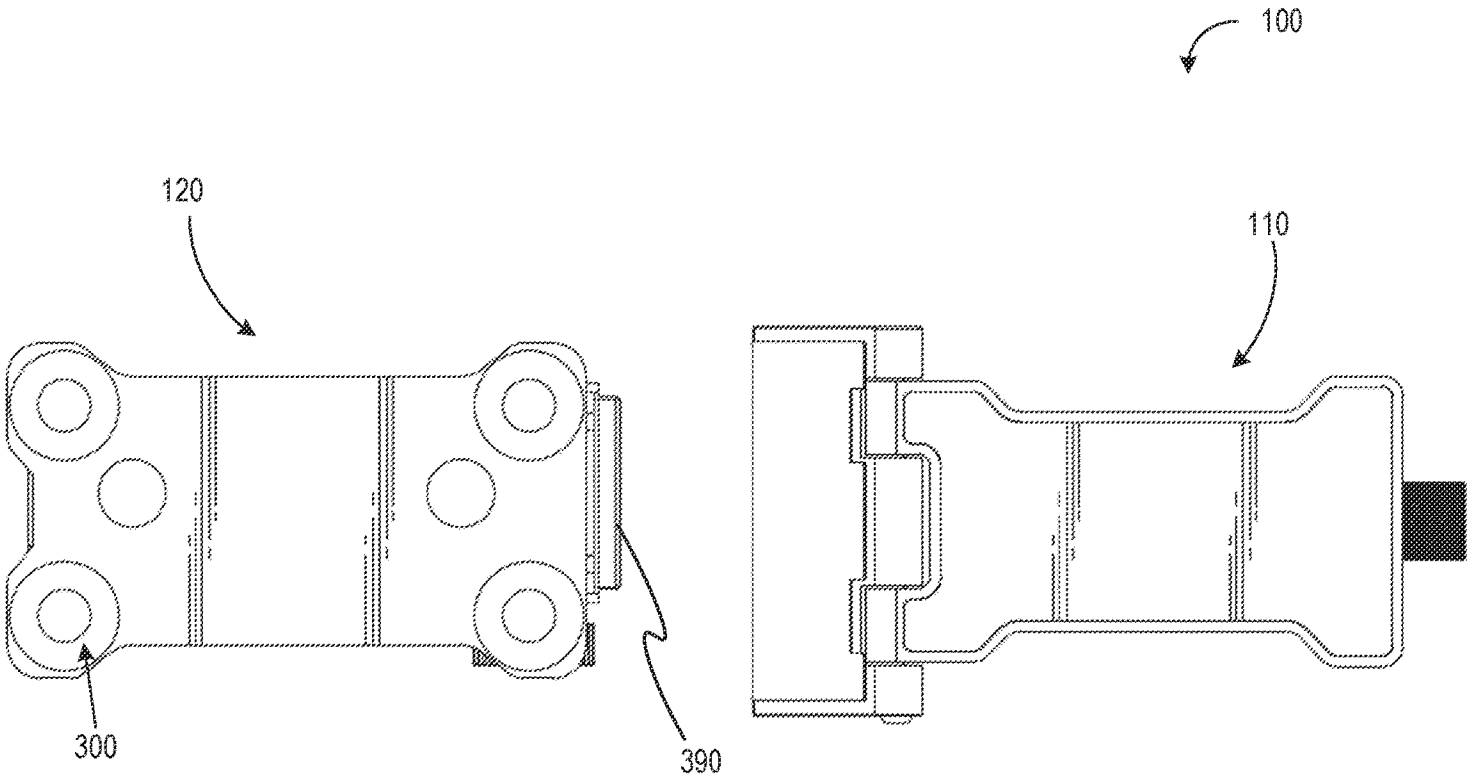
FIG. 9 illustrates a bottom plan view of the adjustable angle roller sharpener of FIG. 4.
Figure 10:
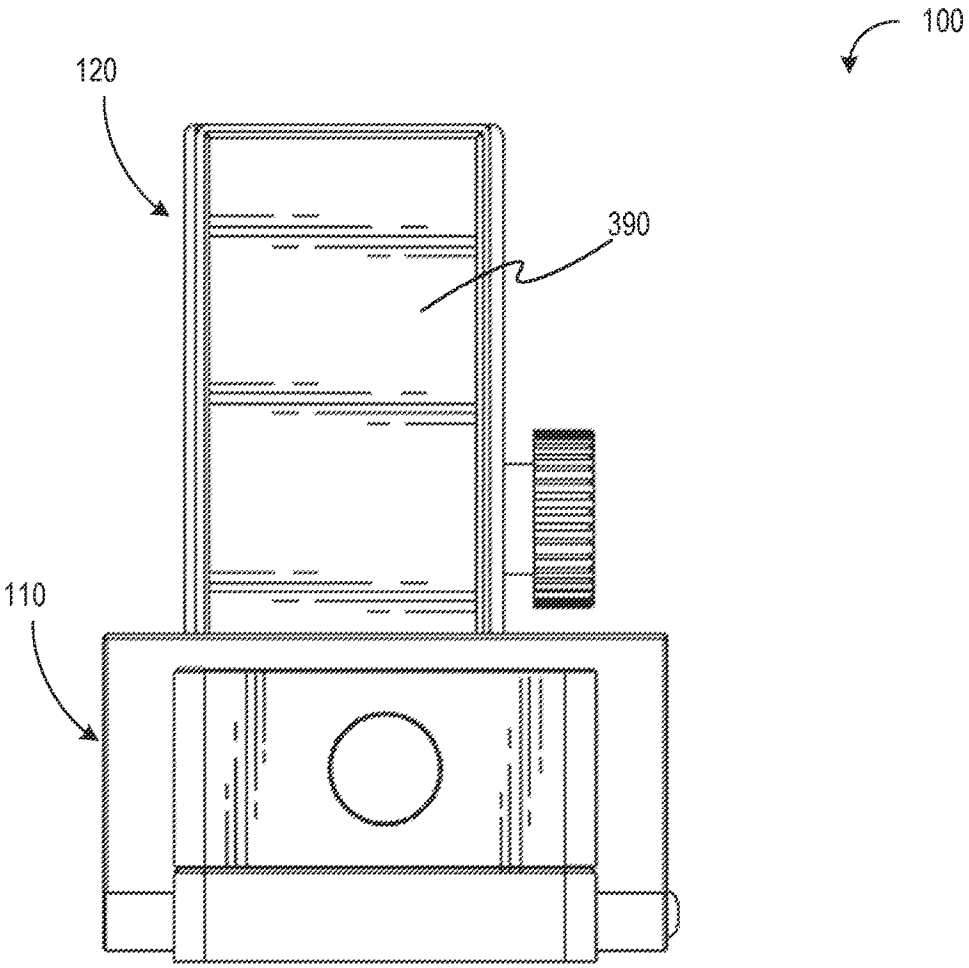
FIG. 10 illustrates a left elevational view of the adjustable angle roller sharpener of FIG. 4.
Figure 11:
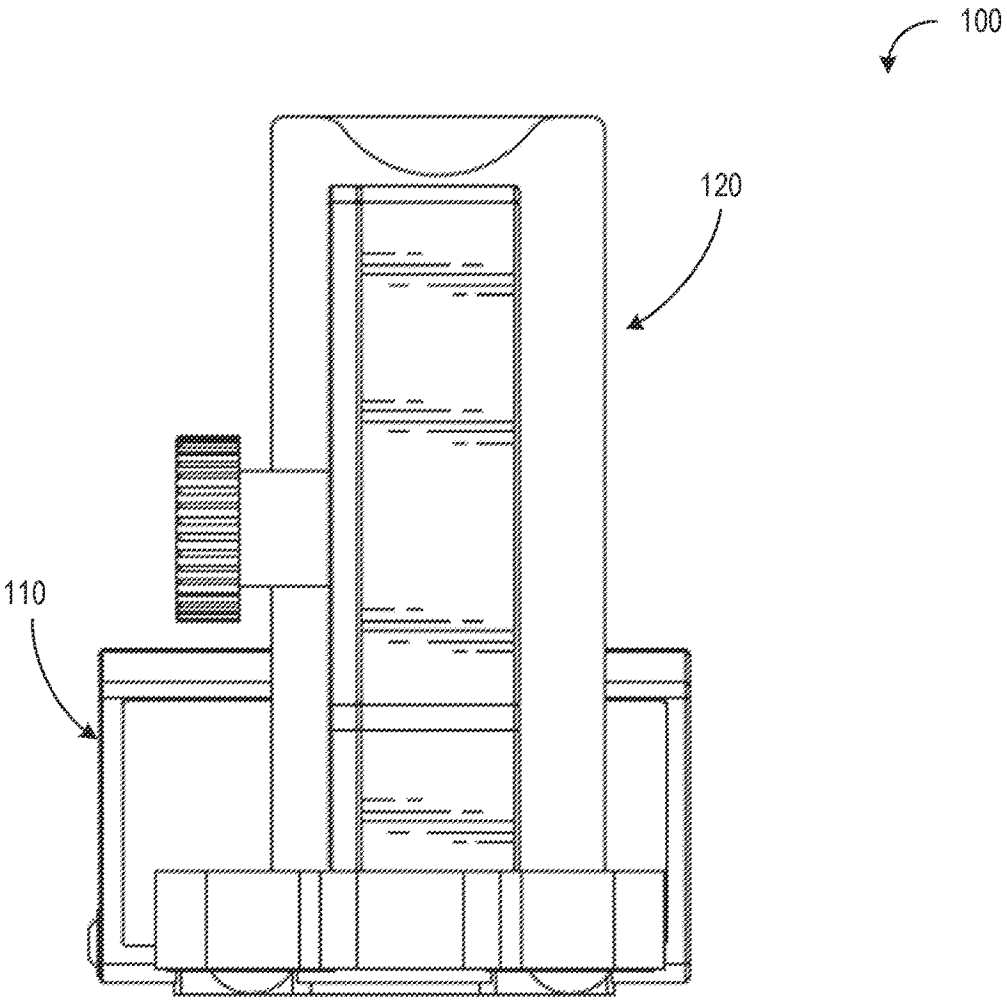
FIG. 11 illustrates a right elevational view of the adjustable angle roller sharpener of FIG. 4.
Figure 12:
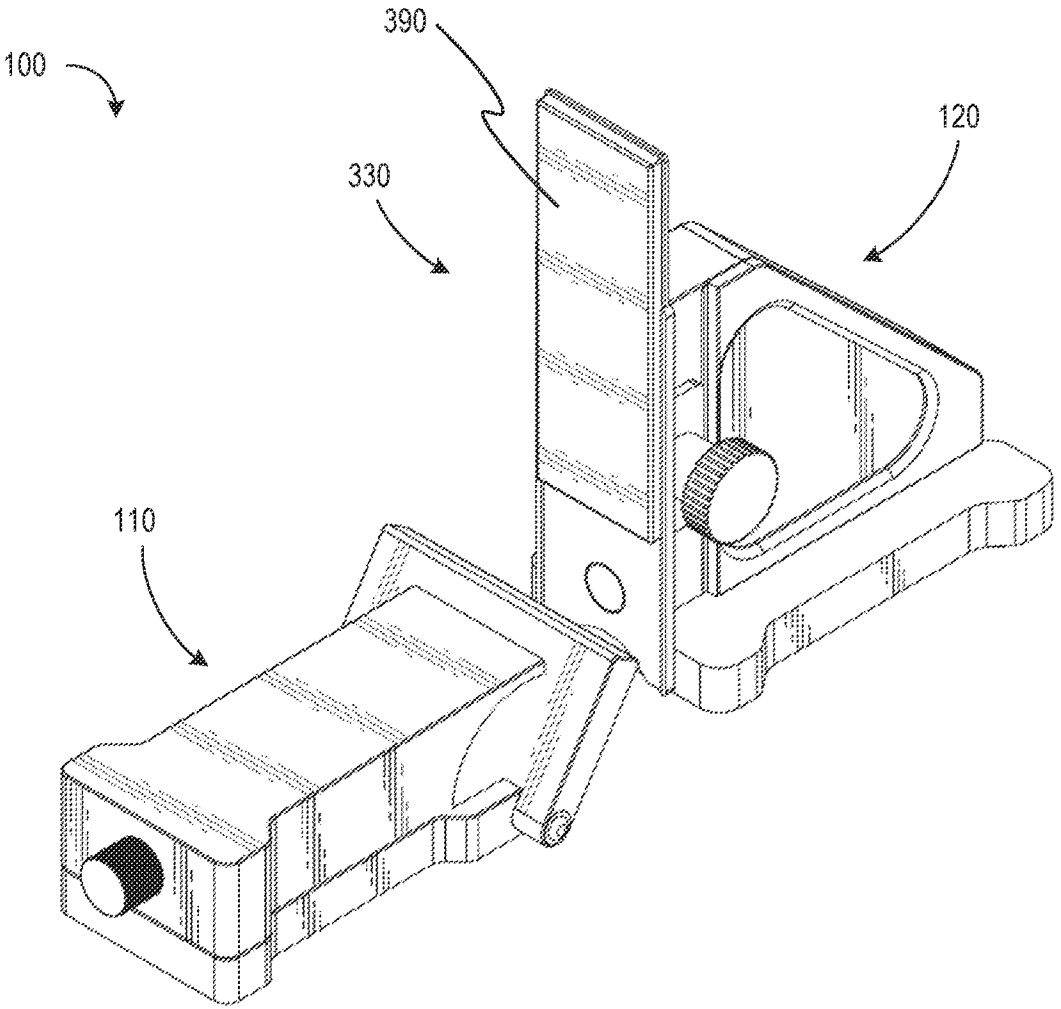
FIG. 12 illustrates a front perspective view of the adjustable angle roller sharpener, similar to FIG. 4, but with the height of the grinding plate shown adjusted upward.
Figure 13:
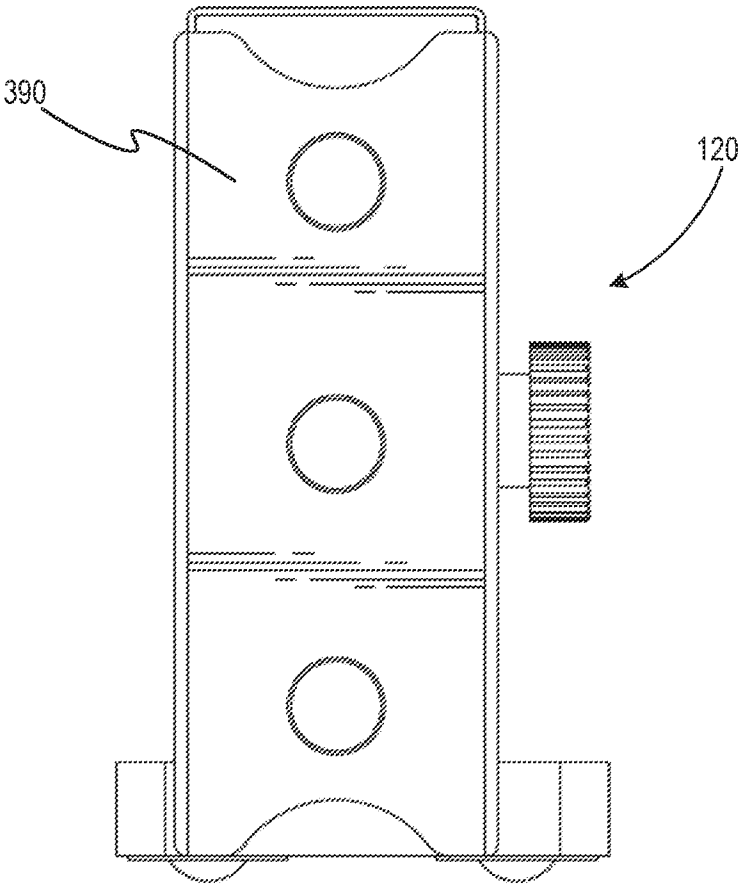
FIG. 13 illustrates a left elevational view of a rolling knife sharpener of the adjustable angle roller sharpener of FIG. 4.
Figure 14:
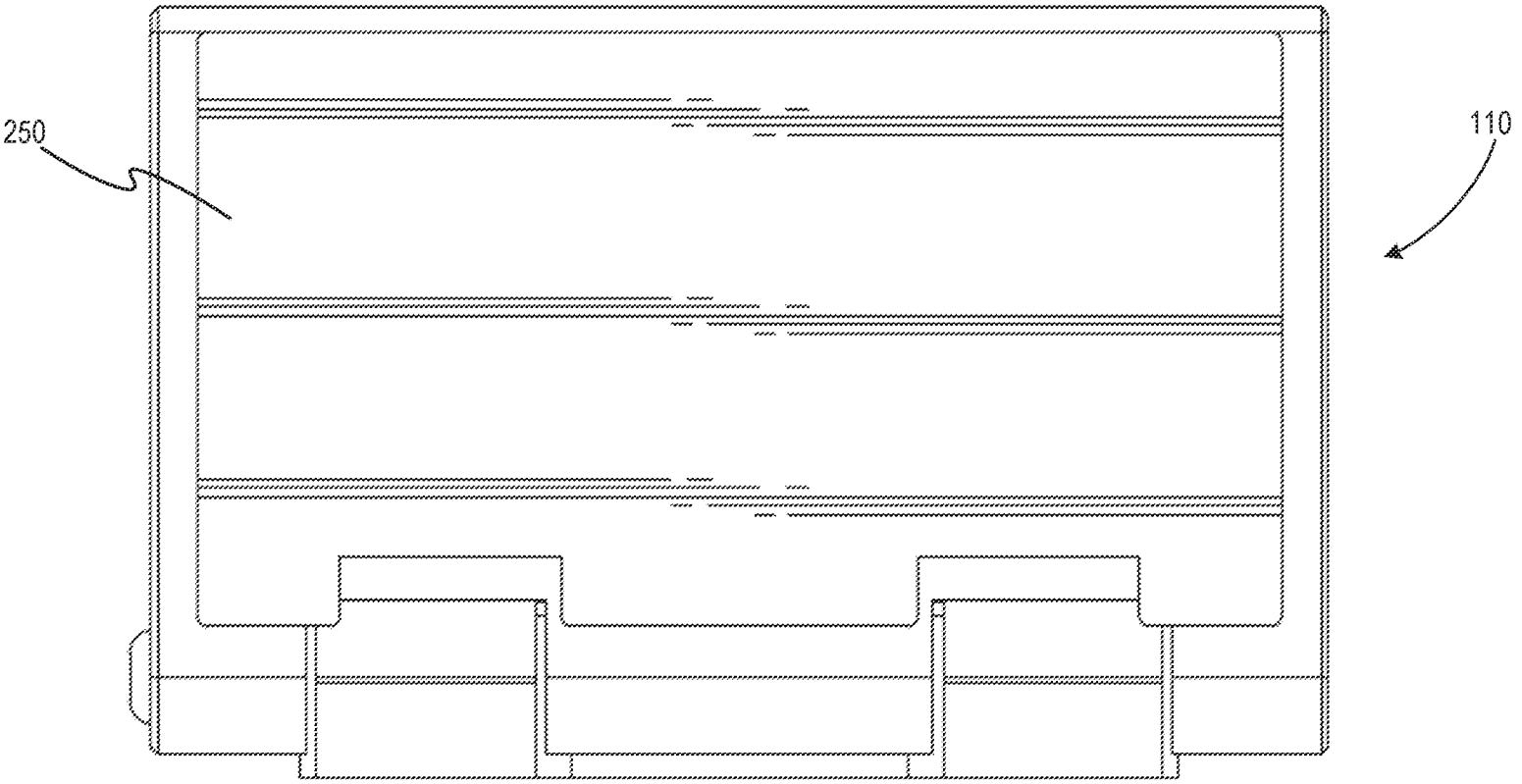
FIG. 14 illustrates a right elevational view of an adjustable magnetic knife holder of the adjustable angle roller sharpener of FIG. 4.
Figure 15:
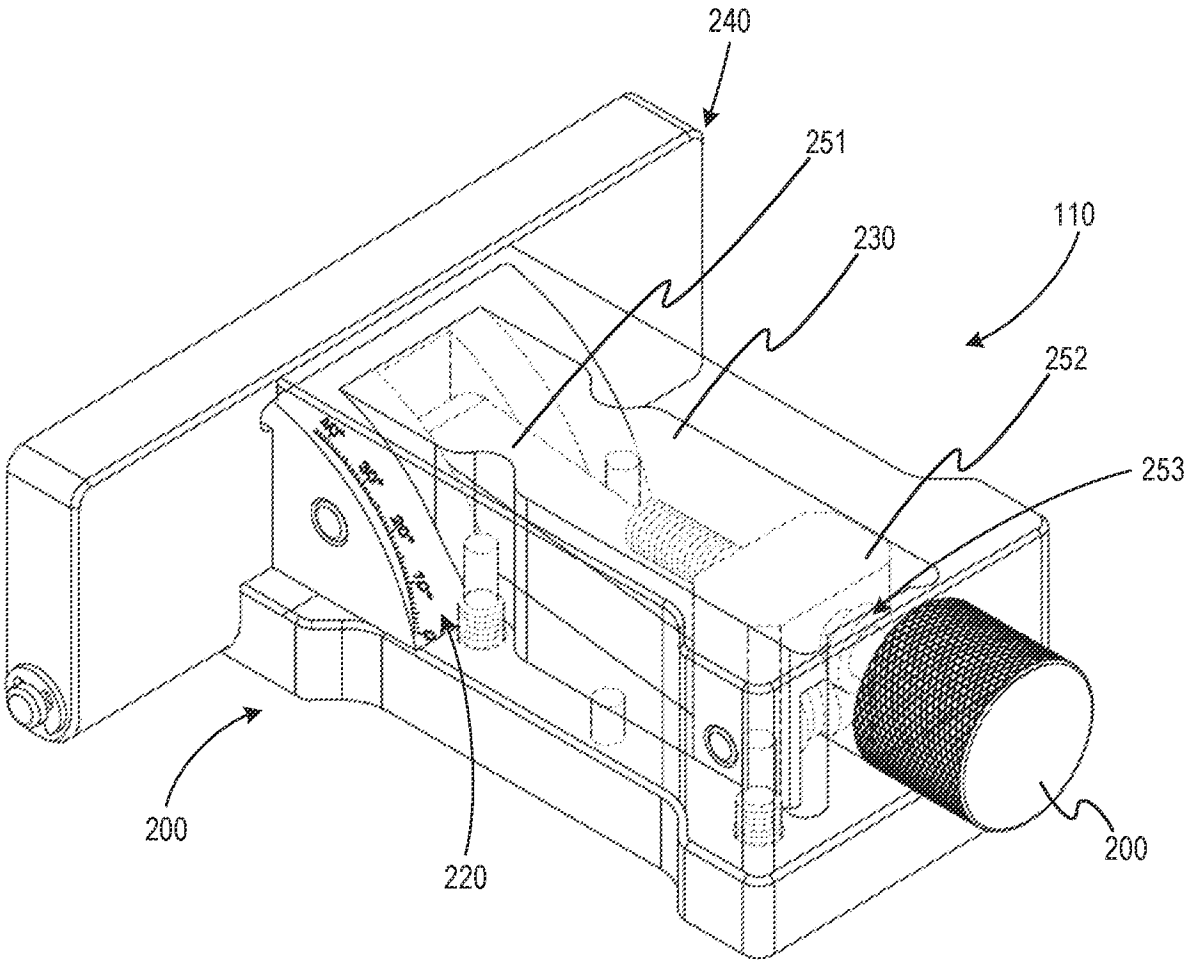
FIG. 15 illustrates a front perspective view of the adjustable magnetic knife holder of the adjustable angle roller sharpener of FIG. 4, and shows hidden portions of an adjustable angle assembly of the adjustable magnetic knife holder.
Figure 16:
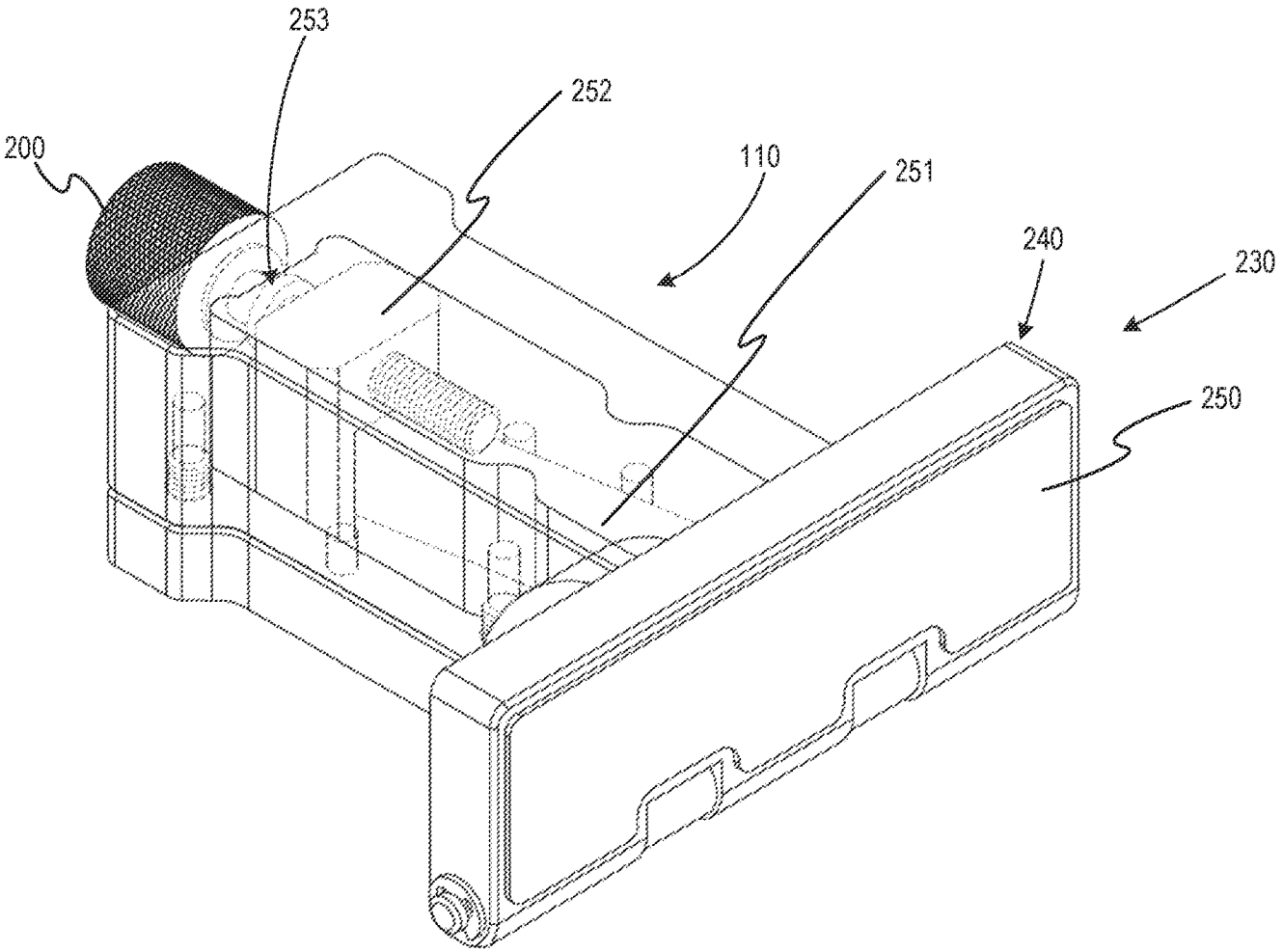
FIG. 16 illustrates a rear perspective view of the adjustable magnetic knife holder of FIG. 15.
Figure 17:
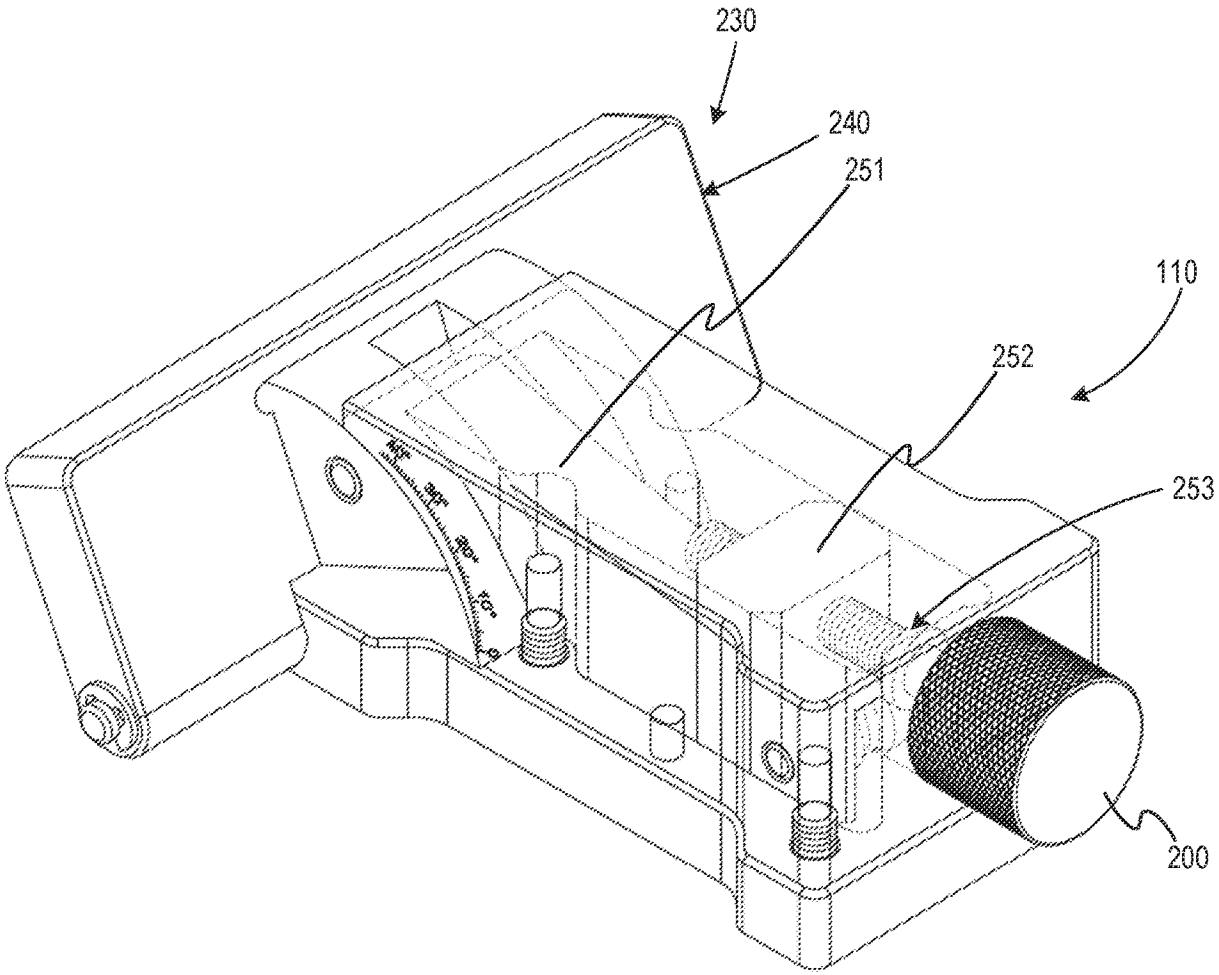
FIG. 17 illustrates another front perspective view of the adjustable magnetic knife holder of FIG. 15.
Figure 18:
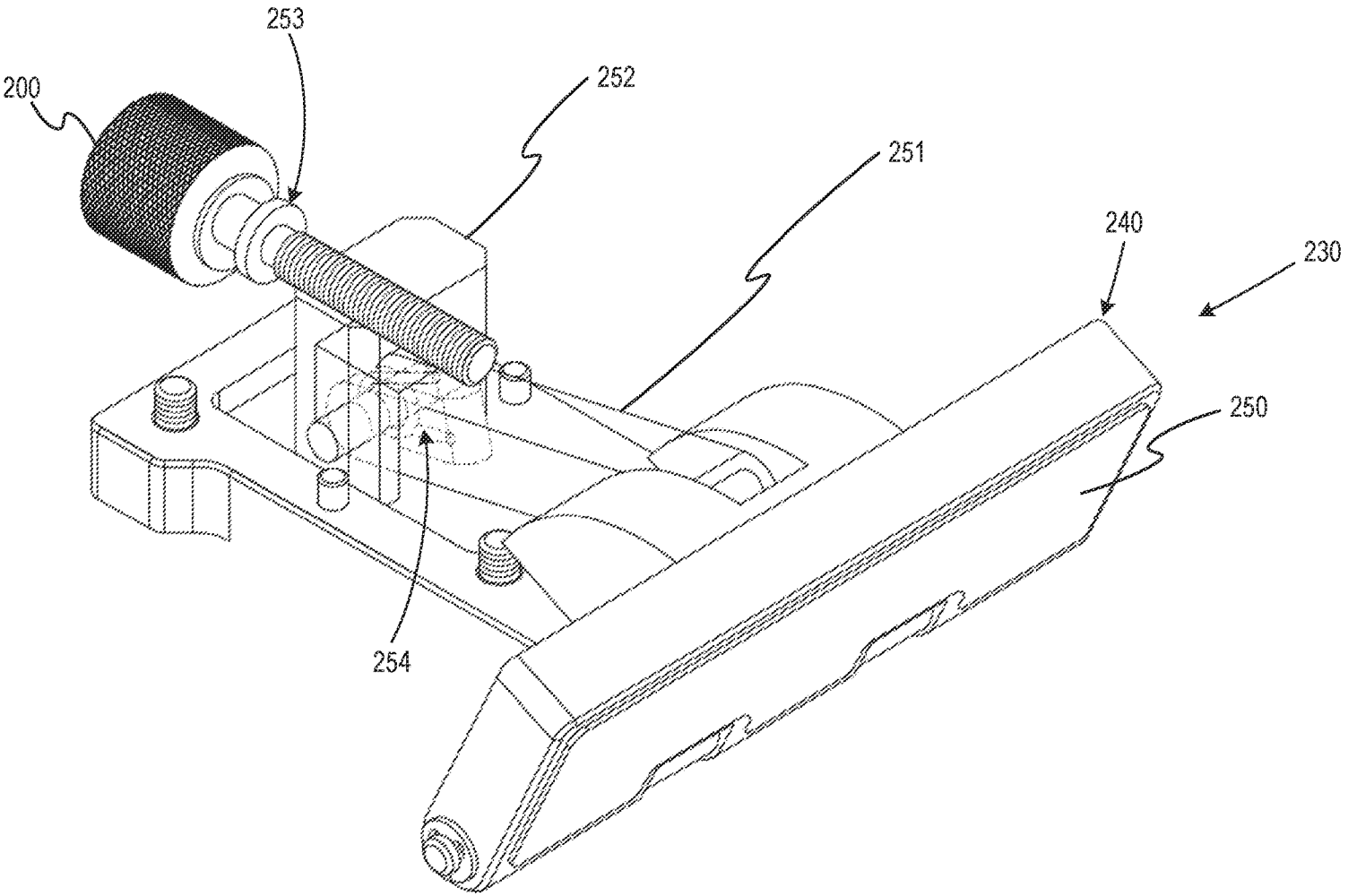
FIG. 18 illustrates a rear perspective view of the adjustable angle assembly of the adjustable magnetic knife holder of FIG. 15.

Reference will now be made to the figures to describe various aspects of example embodiments of the disclosure. FIG. 1 depicts an adjustable angle roller sharpener 100 comprising and adjustable magnetic knife holder 110 and a rolling knife sharpener 120 configured to provide exceptionally sharp and long-lasting edges 130 of blades 135 of knives 140 or other cutting objects.

The adjustable magnetic knife holder 110 includes a body 150 with a base 160, sides 170, a widened back section 180, and a front section 190. The back section 180 includes a rotatable back sharpening angle knob 200. One side 170 of the body 150 includes a rotatable thumb knob 210 and an opposite side includes angle (e.g., 0 degrees, 10 degrees, 20 degrees, 30 degrees, 40 degrees) markings 220. With reference to FIGS. 15-18, an adjustable angle assembly 230 includes an adjustable angle member 240 that is pivotally coupled to the front section 200 and receives a knife holder magnet 250 for magnetically attracting the knife 140 with the edge 130 to be sharpened to a front of the adjustable angle member 240. The adjustable angle assembly 230 includes a connecting rod 251, a slider 252, a lead screw 253, and a torsion spring 254. The knob 200 is turned so that the lead screw 253 drives the slider 252 to move forward and rearward so that the slider 252 pushes out the adjustable angle member 240 through the connecting rod 251, thereby achieving angle adjustment action in the adjustable angle assembly 230. The torsion spring 254 gives the slider 252 and the connecting rod 251 a pre-tightening force to allow each part to handle the stress state, thereby reducing shaking/play of/between each part. The adjustable angle assembly 230 of the adjustable magnetic knife holder 110 is precisely adjustable from 10° to 40°, securely holding the knife 140 at the optimal sharpening angle. This ensures that the blade 135 gets sharpened evenly and effectively across its entire cutting edge 130. Common knife angles are 15 Degrees, 17 Degrees, 20 Degrees, and 22 Degrees. A knife angle of 15 Degrees offers a razor-sharp edge for precise slicing and increased cutting efficiency. The edge 130 may be more delicate and prone to chipping or dulling quickly under heavy use so this knife angle is not meant for chopping jobs. This knife angle is ideal for Damascus, Fillet, Paring, Santoku and Traditional Japanese Knives. A knife angle of 17 Degrees provides a balance between sharpness and durability, making it suitable for a variety of tasks. The edge 130 may not be as fine as a 15 degree angle, affecting some precision tasks. This knife angle is ideal for Boning and Chef Knives. A knife angle of 20 Degrees is ideal for the majority of kitchen knives (using a 20 degree angle is a widely adopted standard in the kitchen knives). This knife angle offers increased durability for heavy-duty tasks and a slightly more robust edge for better edge retention. The edge 130 might not be as sharp as lower angles, impacting some delicate cutting tasks. This knife angle is ideal for Chef, Carving and Pocket Knives. A knife angle of 22 Degrees is ideal for rugged tasks and heavy chopping, providing a robust edge. This knife angle sacrifices some sharpness, making it less ideal for precise slicing. This knife angle is ideal for a Cleaver, Butcher and Pocket Knife.

The rolling knife sharpener 120 includes a base 260 with sides 270 and a widened front section 280 and a widened rear section 290. The base 260 includes bottom rollers 300 (FIGS. 7, 9) and supports a vertical support 310 and triangular shaped handle 320. An adjustable height assembly 330 includes a height adjustment member 340 that is coupled to a thumb knob assembly 350 including a bracket 360 and rotatable thumb knob 370 for vertical adjustment of the height adjustment member 340 relative to the vertical support 310. The height adjustment member 340 receives a plate holder magnet 380 for magnetically attracting a diamond grinding plate (e.g., diamond 400 #grinding plate 390, diamond 800 #grinding plate 400, ceramics 1000 #plate 410, 3000 #whetstone, 6000 #whetstone plate) to a front of the height adjustment member 340 for sharpening the edge 130 of the knife 140. The diamond 400 #grinding plate 390 and the diamond 800 #grinding plate 400 utilize industrial diamonds to effectively sharpen steel knives 140 of different hardness. The plates 390, 400 grind with efficiency and accuracy, producing a fast and top-notch sharpening result. The ceramics 1000 #plate 410 is a honing plate that, with a few gentle rolls back and forth across the blade edge 130, realigns the knife's sharp edge 130 for knife maintenance. The adjustable height assembly 330 provides adjustable plate heights to accommodate narrow and large blades 135 without the need for an extra cutting board to raise the height of the surface. The removable magnetic diamond 400 #grinding plate 390, diamond 800 #grinding plate 400, ceramics 1000 #plate 410, 3000 #whetstone, and 6000 #whetstone plate allow for easy transitions while the bottom rollers 300 allow for smooth back and forth grinding.

With reference to FIGS. 19-29, the adjustable magnetic knife holder 110 will now be described in use.

Figure 19:
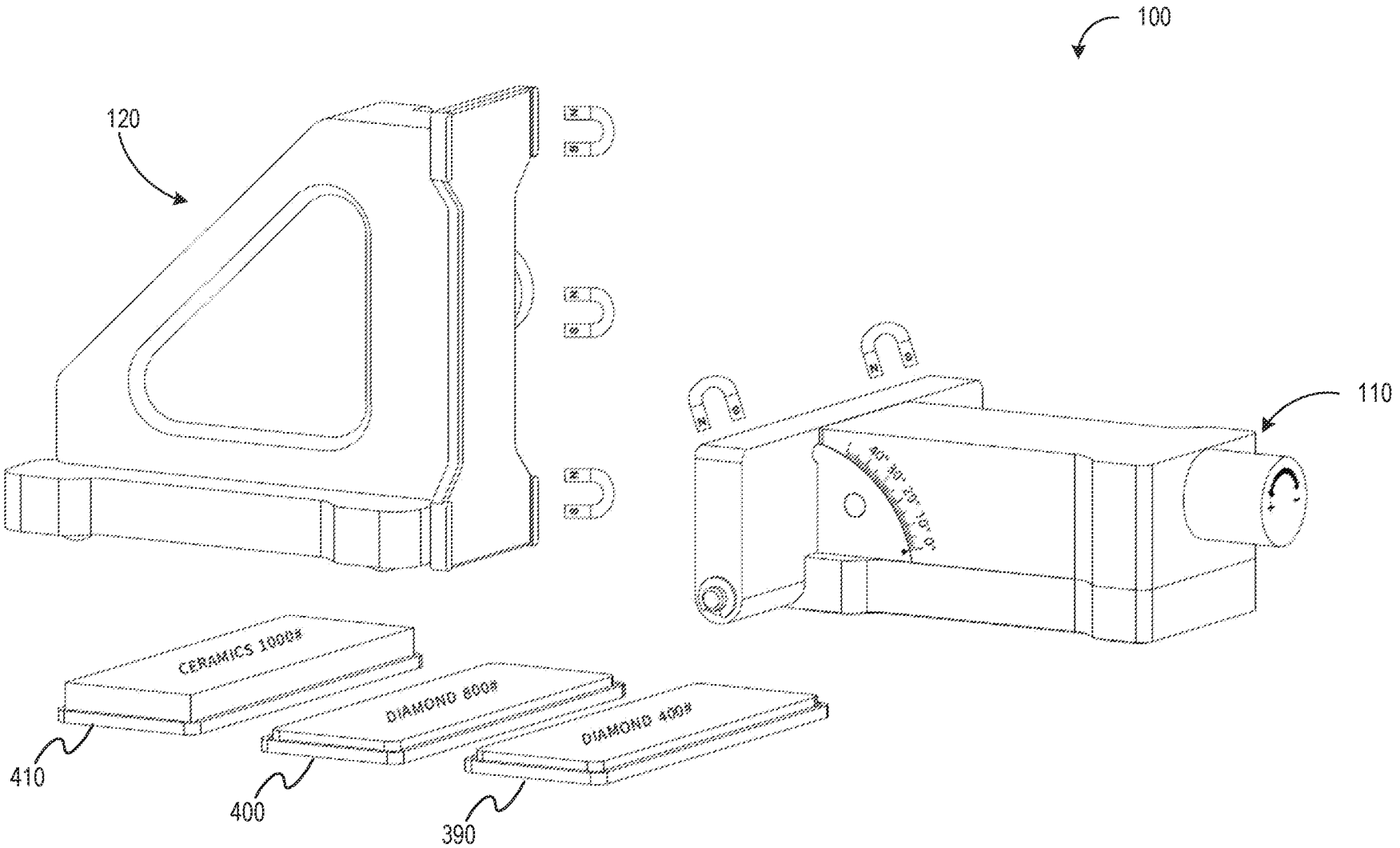
FIG. 19 is a perspective view of the adjustable angle roller sharpener set up on a steady surface such as a cutting board or kitchen counter, ready for use.

First, as shown in FIG. 19, the adjustable angle roller sharpener 100 is set up on a steady surface, preferably on a cutting board or kitchen counter.

Figure 20:
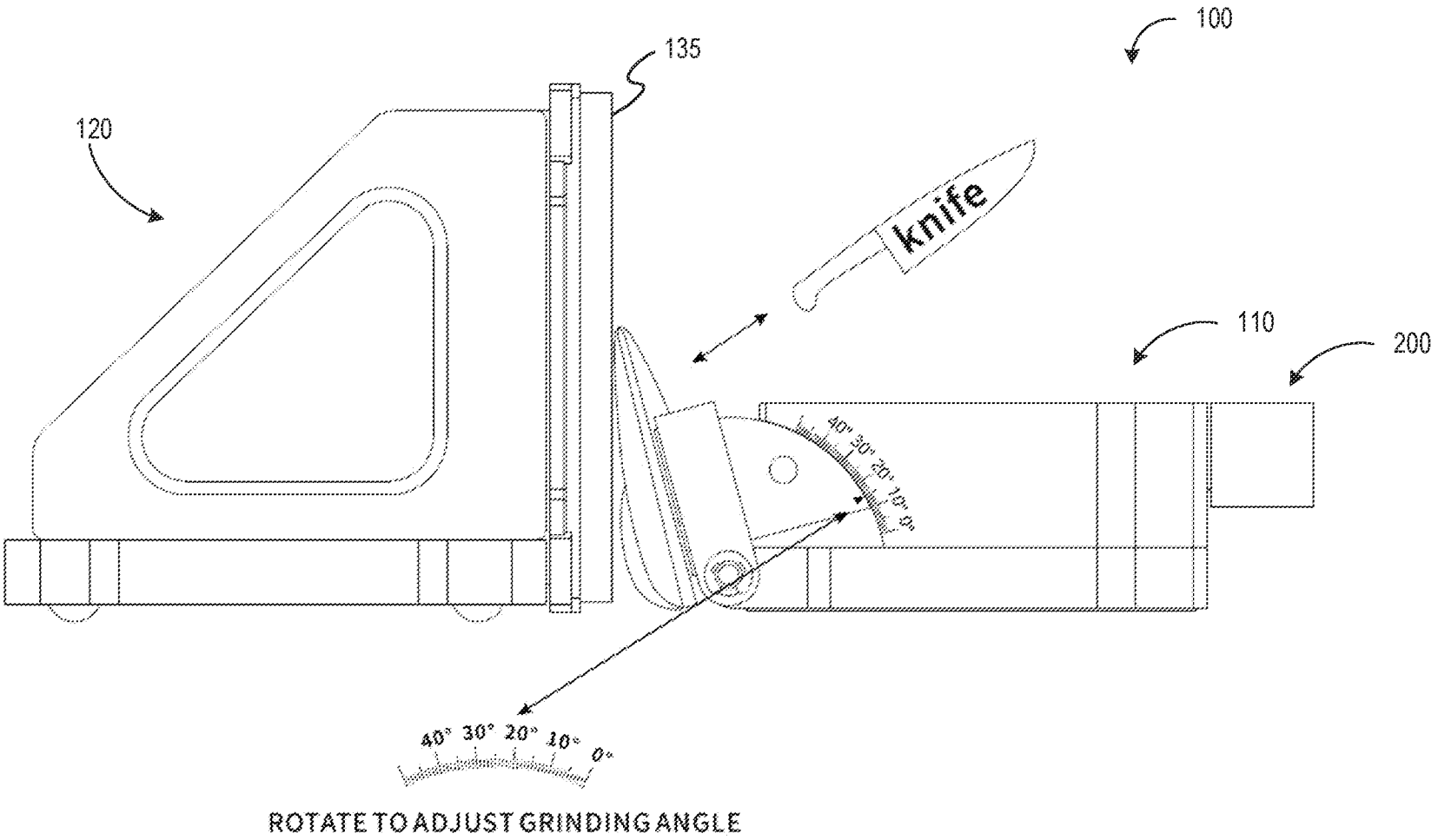
FIG. 20 illustrates rotation of a back knob of the adjustable magnetic knife holder to adjust the sharpening angle of the adjustable angle assembly.

Next, as shown in FIG. 20, the back knob 200 is rotated to adjust the sharpening angle of the adjustable angle assembly 230 appropriate to the blade 135.

Figure 21:
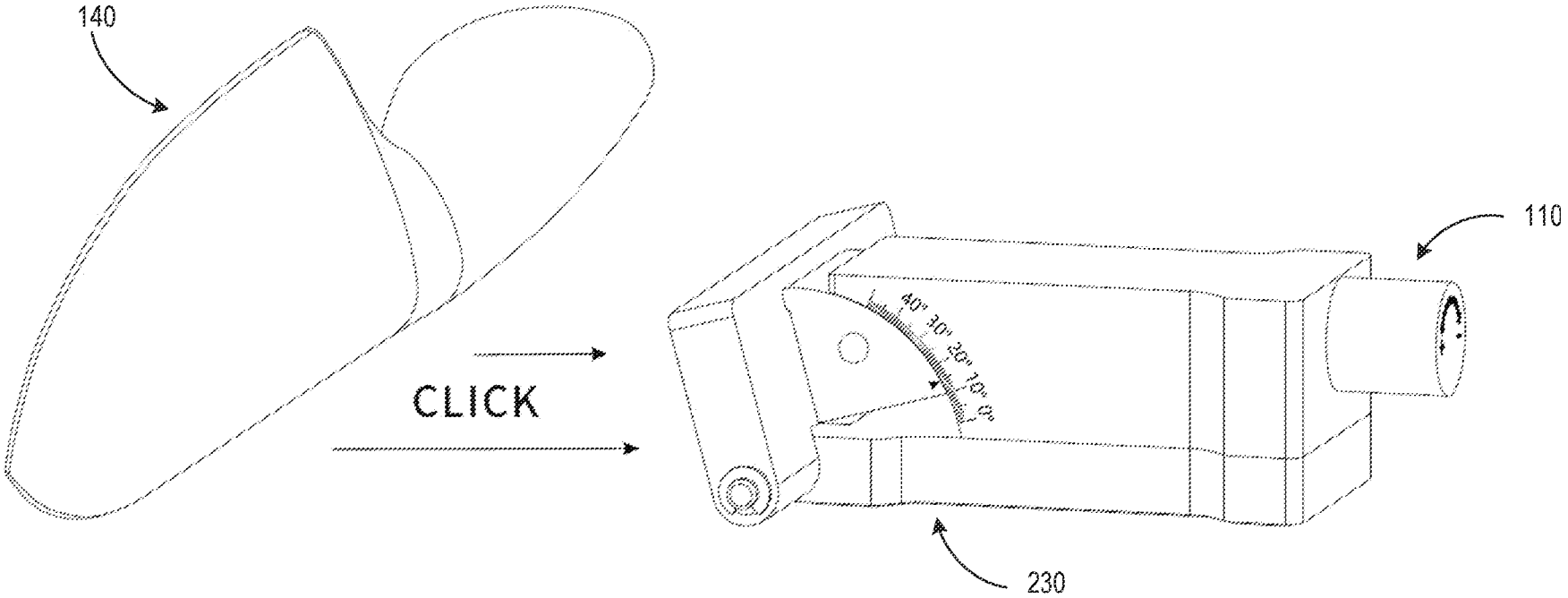
FIG. 21 illustrates a knife securely attached to the desired sharpening angle of the adjustable angle assembly of the magnetic knife holder.

Next, as shown in FIG. 21, the knife 140 is securely attached to the desired sharpening angle of the adjustable angle assembly 230 of the magnetic knife holder 110.

Figure 22:
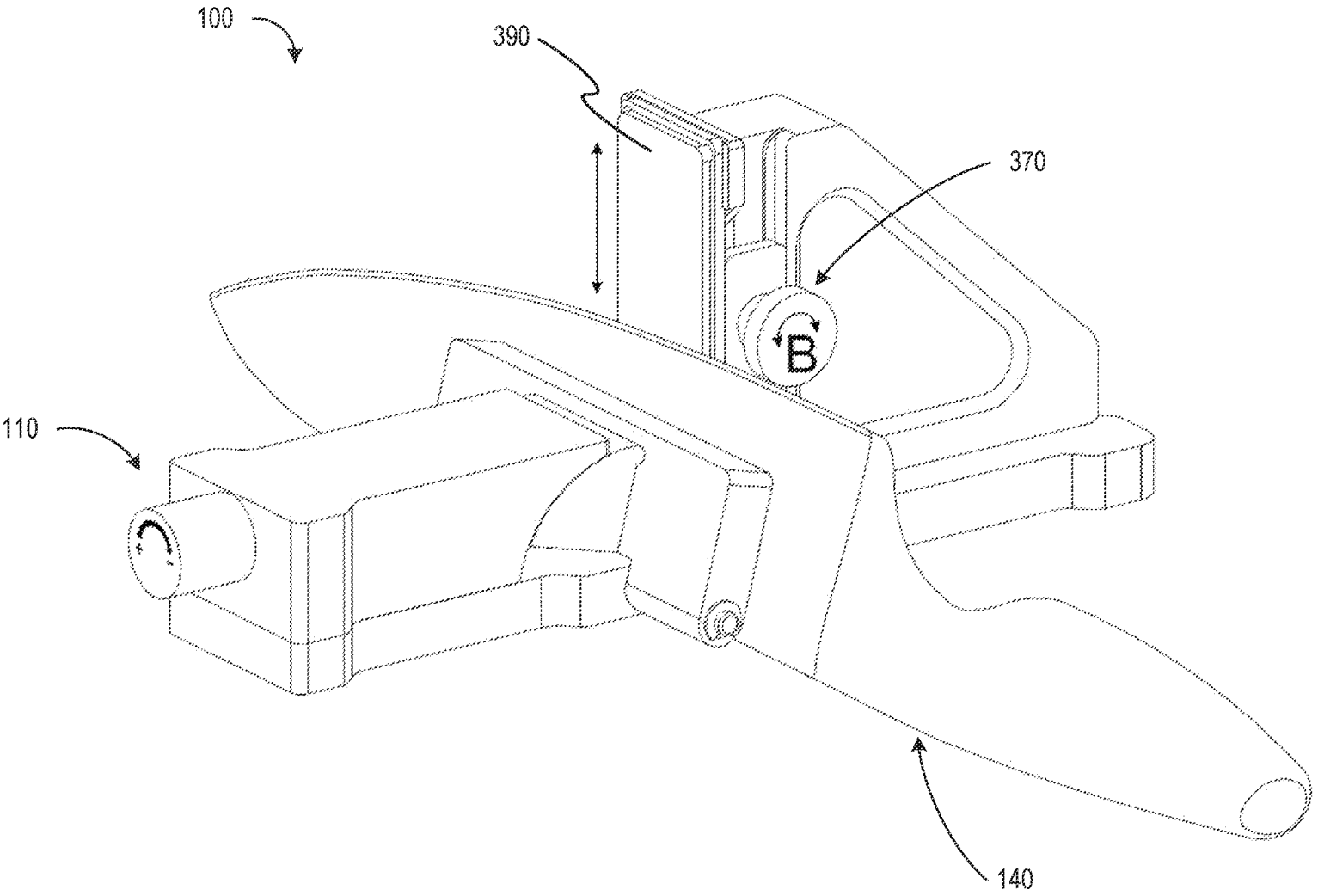
FIG. 22 illustrates rotation of a thumb knob of the rolling knife sharpener to adjust a height of a grinding plate via an adjustable height assembly.

Next, as shown in FIG. 22, the thumb knob 370 is rotated and the height of the plate 390, 400, 410 is adjusted as needed to ensure the entire blade 135 can be grinded.

Figure 23:
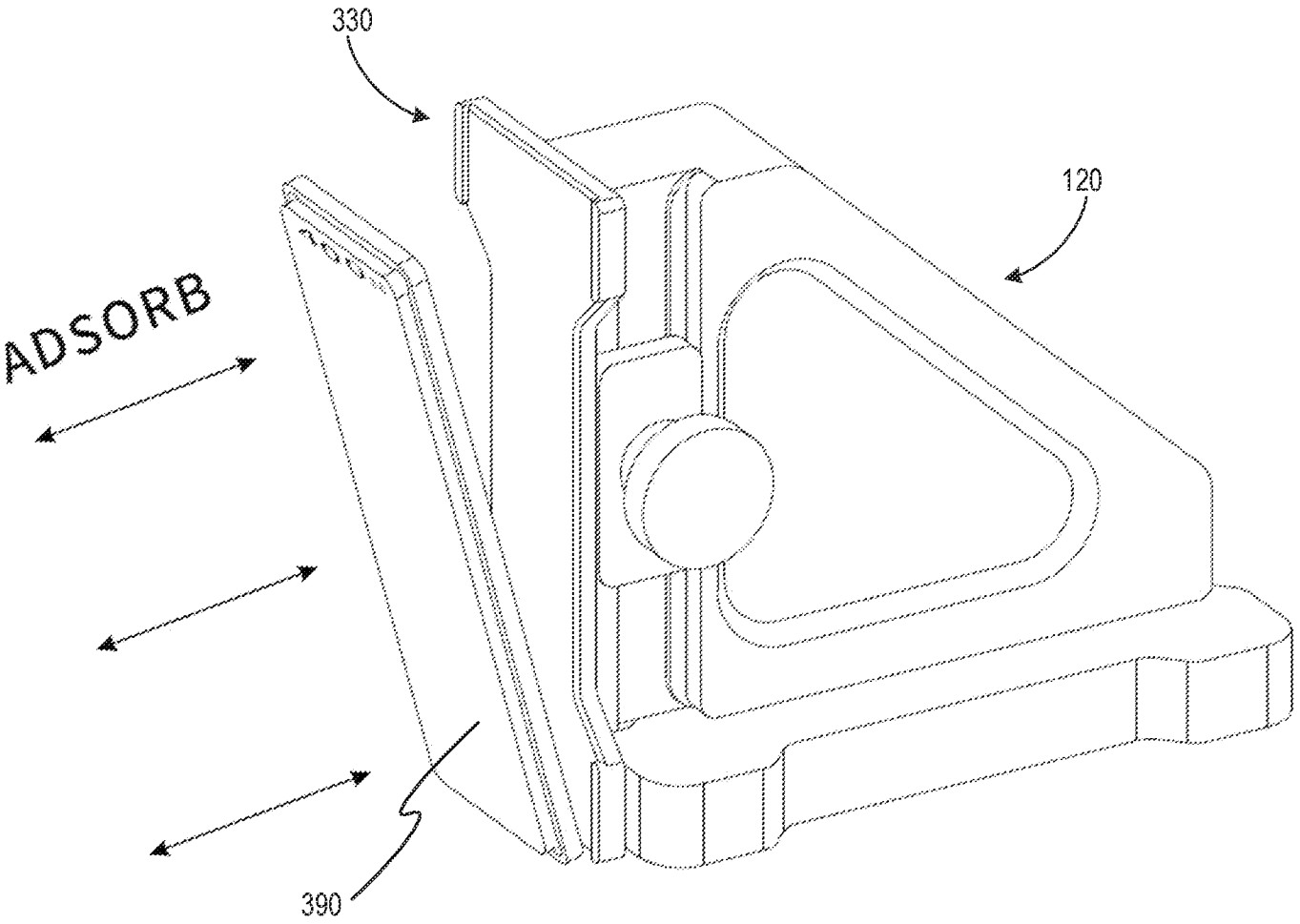
FIG. 23 illustrates a diamond 400 #grinding plate attached to the adjustable height assembly of the knife sharpener.

Next, as shown in FIG. 23, the diamond 400 #grinding plate 390 is attached to the adjustable height assembly 330 of the knife sharpener 120.

Figure 24:
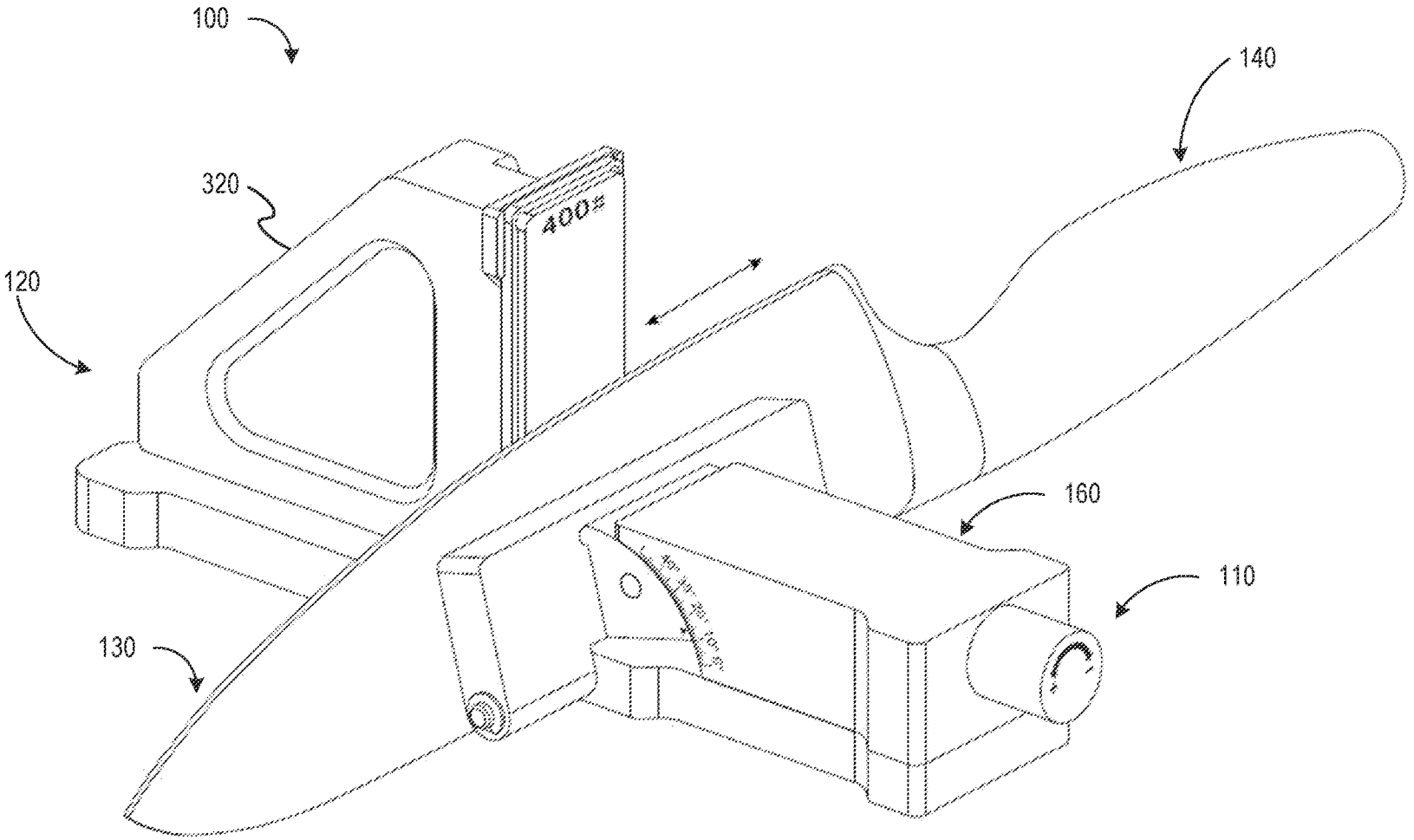
FIG. 24 illustrates use of the magnetic knife holder and the rolling sharpener to sharpen a cutting edge of a knife.

Next, as shown in FIG. 24, the base 160 of the magnetic knife holder 110 is gripped with one hand while holding the handle 320 of the rolling sharpener 120 with the other hand. The rolling sharpener 120 is glided back and forth along the entire cutting edge 130 with gentle, effortless movements. The diamond's efficiency is exceptional, so pressing hard is unnecessary as it will grind enough material from the edge 130 effortlessly.

Figure 25:
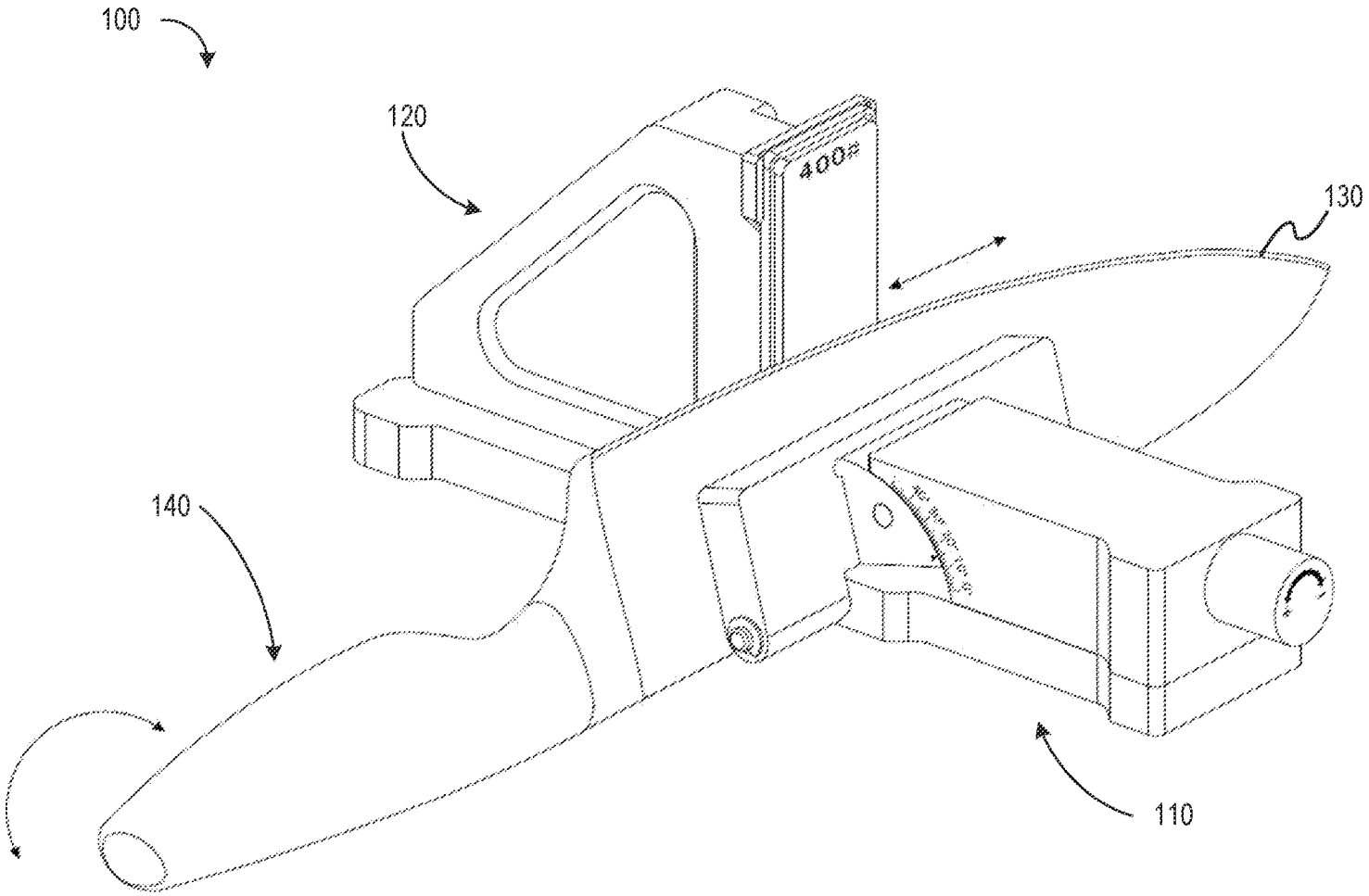
FIG. 25 illustrates rotating the knife 180 degrees to sharpen the cutting edge on an opposite side of the blade.
Figure 26:
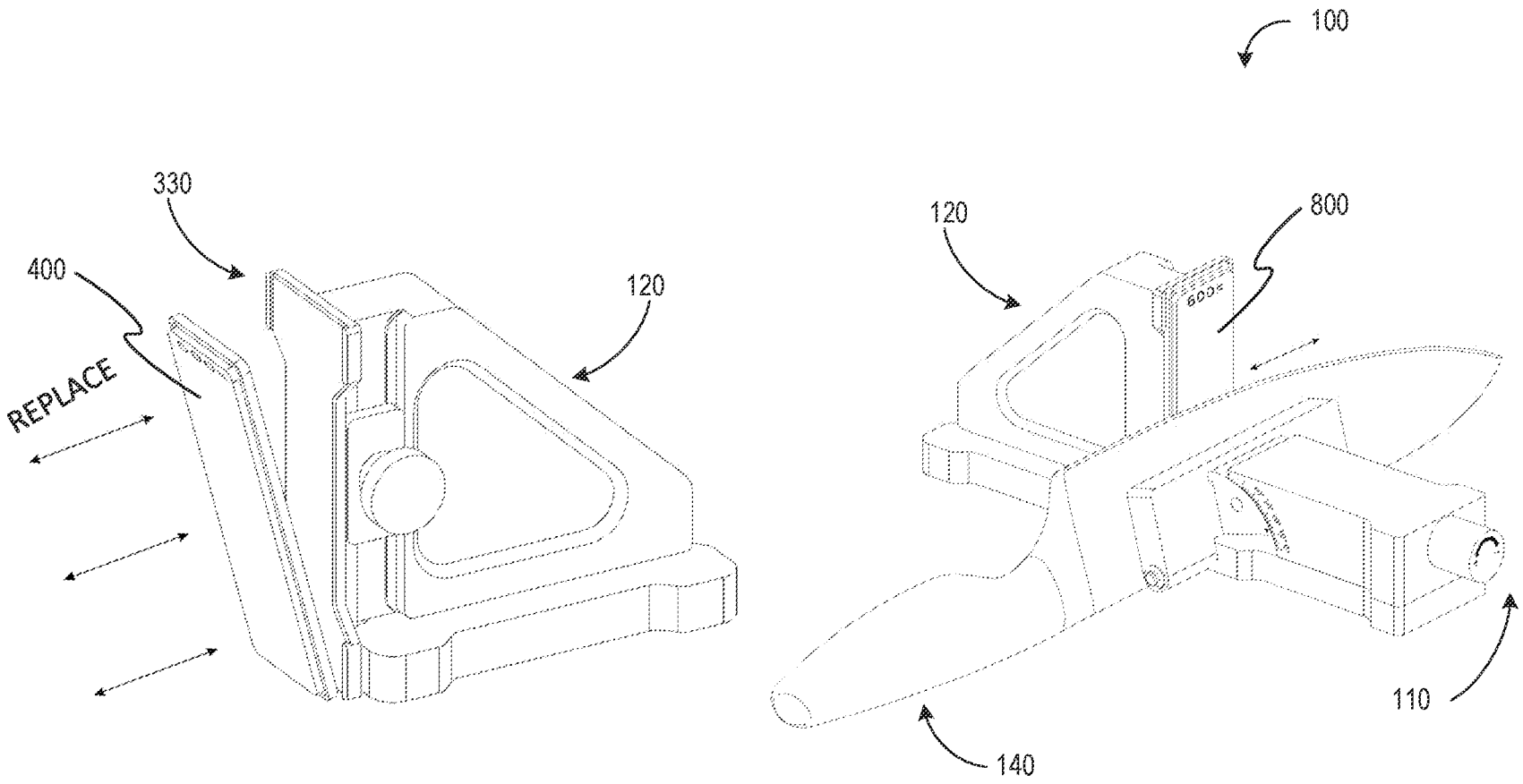
FIG. 26 illustrates replacement of the diamond 400 #grinding plate with a diamond 800 #grinding plate, and use of the magnetic knife holder and the rolling sharpener to sharpen a cutting edge of a knife.

Next, as shown in FIG. 25, the first sharpening of the blade's edge 130 is completed. Next, the knife 140 is rotated 180 degrees and the opposite side of the blade 135 is positioned onto the magnetic holder 110. The grinding process is continued, ensuring both sides are sharpened uniformly at the chosen angle Next, as shown in FIG. 26, the diamond 400 #grinding plate 390 is replaced with the diamond 800 #grinding plate 400 and the diamond 800 #grinding plate 400 is attached to the adjustable height assembly 330 of the knife sharpener 120. Grinding proceeds as described above with respect to FIG. 24. The rolling sharpener 120 is glided back and forth along the entire cutting edge 130 with gentle, effortless movements.

Figure 27:
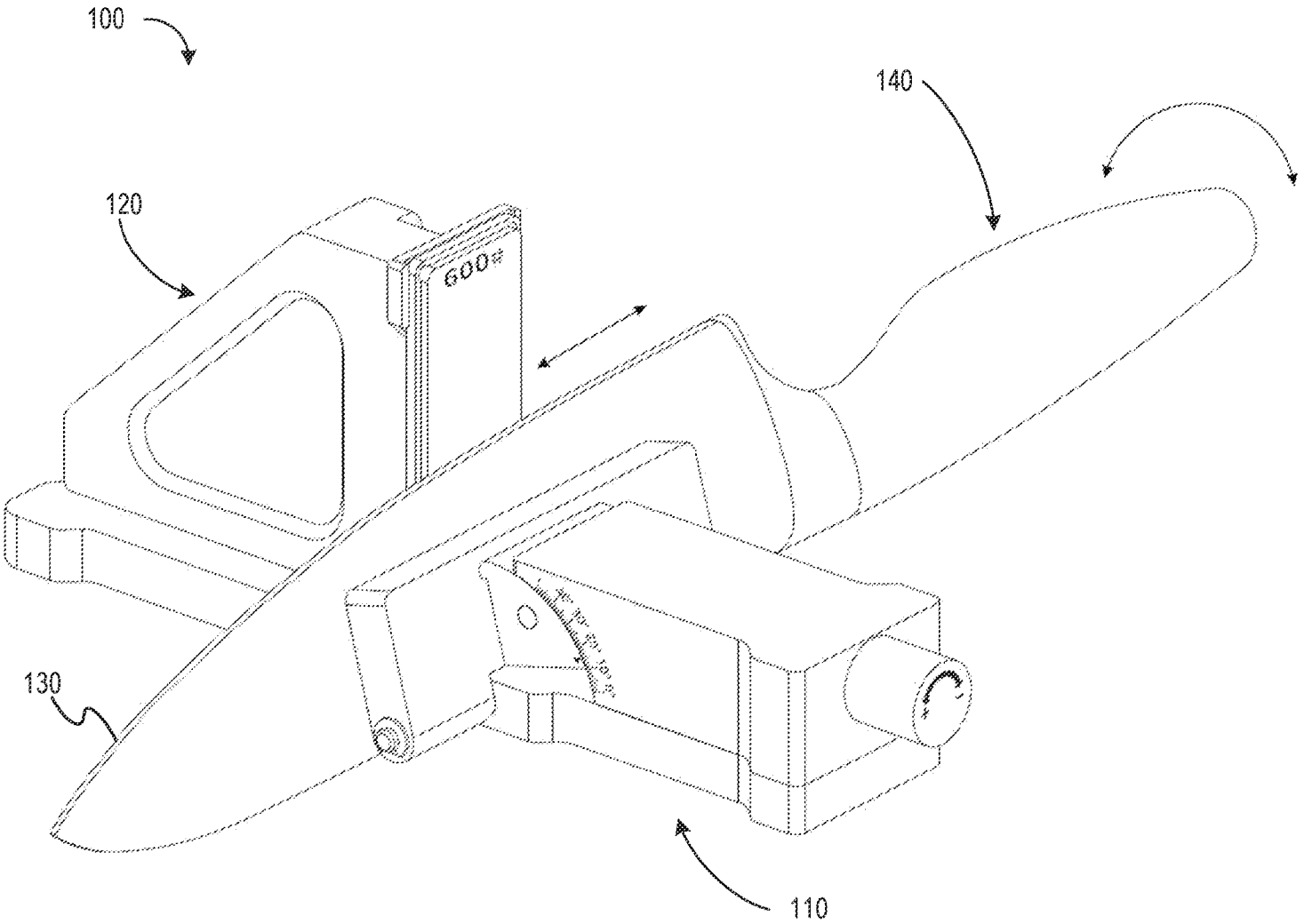
FIG. 27 illustrates rotation of the knife 180 degrees with respect to the magnetic knife holder, and use of the magnetic knife holder and the rolling sharpener to sharpen a cutting edge of a knife.

Next, as shown in FIG. 27, the knife 140 is rotated 180 degrees and the opposite side of the blade 135 is positioned onto the magnetic holder 110. The grinding process is continued, ensuring both sides are sharpened uniformly at the chosen angle.

Figure 28:
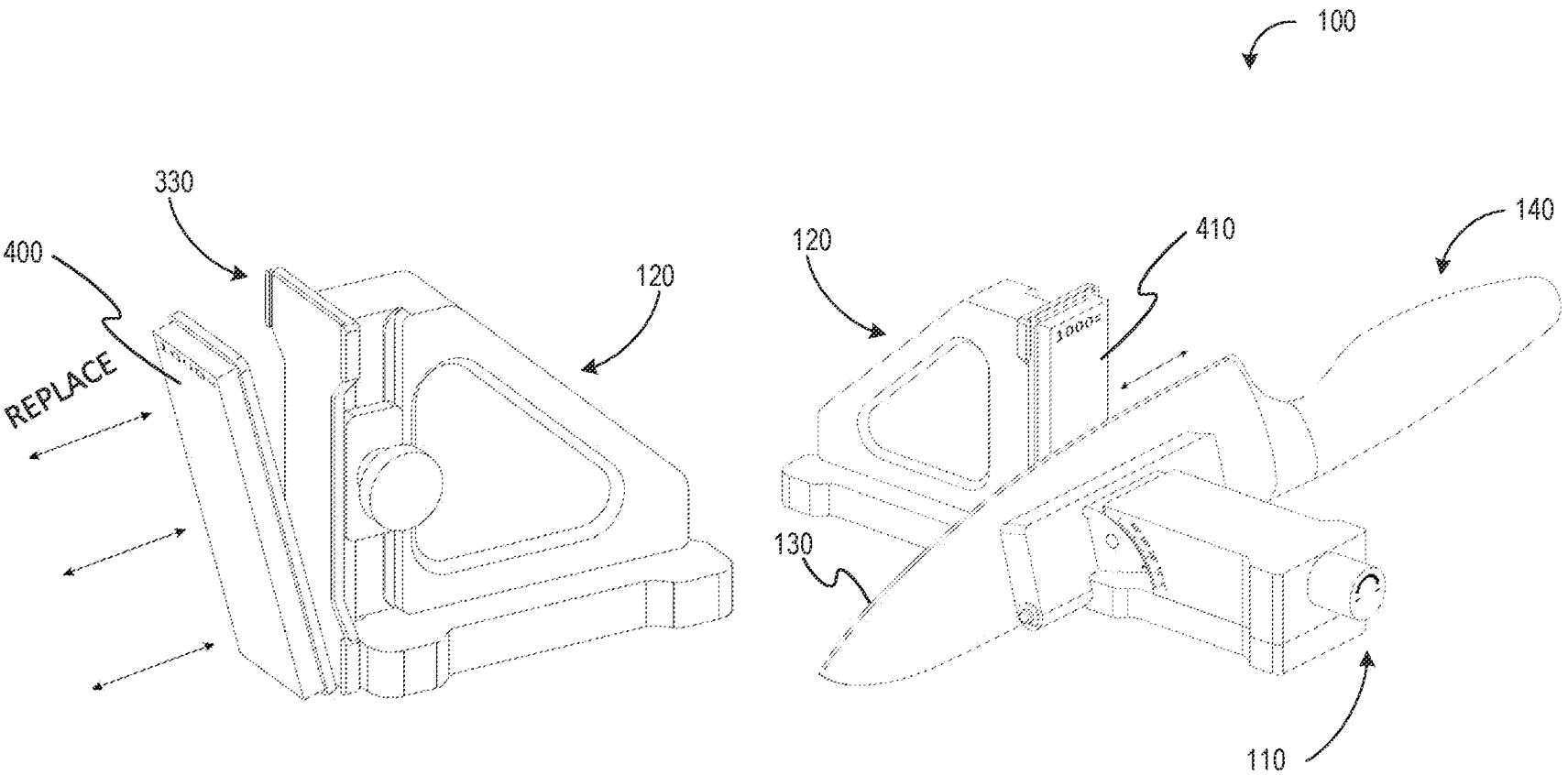
FIG. 28 illustrates replacement of the diamond 800 #grinding plate 400 with a ceramics 1000 #plate, and use of the magnetic knife holder and the rolling sharpener to sharpen a cutting edge of a knife.

Next, as shown in FIG. 28, the diamond 800 #grinding plate 400 is replaced with the ceramics 1000 #plate 410 and the ceramics 1000 #plate 410 is attached to the adjustable height assembly 330 of the knife sharpener 120. The grinding process is continued, grinding the knife 140 back and forth. When honing the blade 135 on one side, a slight burr might form at the cutting edge's tip. To eliminate this, the same rolling movement is initiated with the ceramics 1000 #plate 410. Performing this process up to 5-6 rolls effectively eliminates the burr. The process can be repeated with a 3000 #whetstone, and/or a 6000 #whetstone plate.

Figure 29:
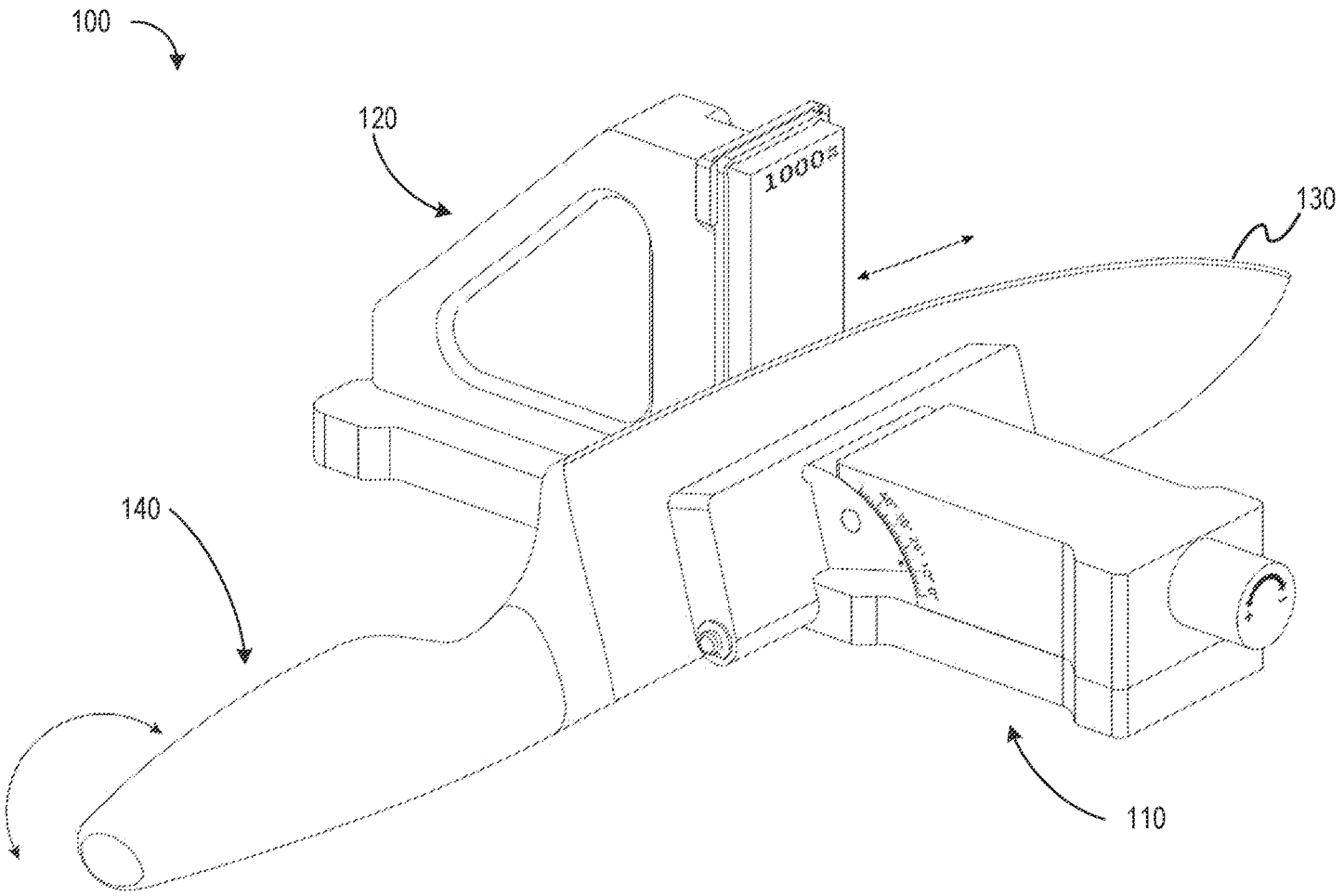
FIG. 29 illustrates rotation of the knife 180 degrees with respect to the magnetic knife holder, and use of the magnetic knife holder and the rolling sharpener to sharpen a cutting edge of a knife.

Next, as shown in FIG. 29, the knife 140 is rotated 180 degrees and the opposite side of the blade 135 is positioned onto the magnetic holder 110. The grinding process is continued, ensuring both sides are sharpened uniformly at the chosen angle.

Finally, the knife 140 is cleaned, washed, and dried prior to using.

The adjustable angle roller sharpener 100 provides exceptionally sharp and long-lasting edges for knives 140. The advanced diamond abrasive and ceramic honing incorporated into the adjustable angle roller sharpener 100 produces sharp and durable edges 130 on the knives 140. With the adjustable angle roller sharpener 100, one can effortlessly achieve a shaving-sharp edge on most of one's knives. The initial sharpening process takes approximately 4-8 minutes, depending on the blade's condition and hardness, because it is unlikely that the knife 140 has a precise grinding angle of 15°, 17°, 20° or 22° straight from the factory; the knife's edge 130 needs to adapt to the new and consistent sharpening angle. Subsequent touchup resharpening can be done in approximately 1-2 minutes. This rapid resharpening capability allows one to maintain razor-sharp knives 140 on a regular basis.

The foregoing description and drawings comprise illustrative embodiments of the present invention. Having thus described exemplary embodiments of the present invention, it should be noted by those skilled in the art that the within disclosures are exemplary only, and that various other alternatives, adaptations, and modifications may be made within the scope of the present invention. Merely listing or numbering the steps of a method in a certain order does not constitute any limitation on the order of the steps of that method. Many modifications and other embodiments of the invention will come to mind to one skilled in the art to which this invention pertains having the benefit of the teachings presented in the foregoing descriptions and the associated drawings. Although specific terms may be employed herein, they are used in a generic and descriptive sense only and not for purposes of limitation. Accordingly, the present invention is not limited to the specific embodiments illustrated herein, but is limited only by the following claims.

We claim:

1. A roller sharpener including a blade edge grinding member to sharpen an edge of a blade of a knife, comprising:

a magnetic knife holder configured to hold the blade of the knife at one or more angles; and an adjustable roller sharpener configured to hold the blade edge grinding member at variable heights to sharpen different-sized blades of different knives, the adjustable roller sharpener with grinding member rollable back and forth on a support surface to sharpen the edge of the blade of the knife held to the magnetic knife holder, wherein the magnetic knife holder is an adjustable magnetic knife holder including an adjustable angle assembly configured to adjust the held blade of the knife at the variable angles, the adjustable angle assembly including a rotatable back sharpening angle knob, an adjustable angle member, a knife holder magnet carried by the adjustable angle member and configured to magnetically hold the blade of the knife, a connecting rod, a slider, a lead screw, wherein the knob is rotatable to cause the lead screw to drive the slider to control the adjustable angle member via the connecting rod to adjust the angle of the adjustable angle member, knife holder magnet, and the blade.

2. The roller sharpener of claim 1, wherein the adjustable angle assembly includes a torsion spring configured pretighten the slider and the connecting rod.

3. The roller sharpener of claim 1, wherein the adjustable angle assembly is adjustable from 10° to 40°.

4. The roller sharpener of claim 3, wherein the adjustable angle assembly is adjustable to single increments.

5. A roller sharpener including a blade edge grinding member to sharpen an edge of a blade of a knife, comprising:

a magnetic knife holder configured to hold the blade of the knife at one or more angles; and an adjustable roller sharpener configured to hold the blade edge grinding member at variable heights to sharpen different-sized blades of different knives, the adjustable roller sharpener with grinding member rollable back and forth on a support surface to sharpen the edge of the blade of the knife held to the magnetic knife holder, wherein the adjustable roller sharpener includes an adjustable height assembly configured to hold the blade edge grinding member at variable heights to sharpen different-sized blades of different knives and the adjustable height assembly includes a height adjustment member, a plate holder magnet carried by the height adjustment member and configured to magnetically hold the blade edge grinding member.

6. The roller sharpener of claim 5, wherein the adjustable roller sharpener includes a vertical support, and the adjustable height assembly includes a thumb knob assembly with a bracket and a rotatable thumb knob, the thumb knob assembly configured to allow vertical adjustment of the height adjustment member relative to the vertical support.

7. A roller sharpener including a blade edge grinding member to sharpen an edge of a blade of a knife, comprising:

a magnetic knife holder configured to hold the blade of the knife at one or more angles; and an adjustable roller sharpener configured to hold the blade edge grinding member at variable heights to sharpen different-sized blades of different knives, the adjustable roller sharpener with grinding member rollable back and forth on a support surface to sharpen the edge of the blade of the knife held to the magnetic knife holder, wherein the adjustable roller sharpener includes bottom rollers configured to enable the adjustable roller sharpener back and forth on a support surface to sharpen the edge of the blade of the knife held to the magnetic knife holder.

8. The roller sharpener of claim 1, wherein the blade edge grinding member includes a kit of different types of blade edge grinding members.

9. The roller sharpener of claim 1, wherein the kit of different types of blade edge grinding members include one or more diamond grinding plates and one or more ceramic plates.

10. The roller sharpener of claim 9, wherein the kit of different types of blade edge grinding members include a diamond 400 #grinding plate, a diamond 800 #grinding plate, a ceramics 1000 #plate, a 3000 #whetstone, and a 6000 #whetstone plate.

11. A method of using a roller sharpener including a blade edge grinding member to sharpen an edge of a blade of a knife, the roller sharpener comprising a magnetic knife holder; and an adjustable roller sharpener, wherein the magnetic knife holder is an adjustable magnetic knife holder configured to hold the blade of the knife at variable angles, the adjustable roller sharpener includes an adjustable height assembly configured to hold the blade edge grinding member at variable heights to sharpen different-sized blades of different knives, and the method comprising:

adjusting a sharpening angle of the adjustable angle assembly appropriate to the blade of the knife;

magnetically holding the blade of the knife with the adjustable angle assembly;

adjusting a height of the adjustable height assembly appropriate to the blade of the knife;

magnetically holding the blade edge grinding member with the adjustable height assembly;

sharpening the edge of the blade of the knife held to the magnetic knife holder with the blade edge grinding member by rolling the adjustable roller sharpener with grinding member back and forth on a support surface.

12. The method of claim 11, further comprising replacing the blade edge grinding member with a different blade edge grinding member, and sharpening the edge of the blade of the knife held to the magnetic knife holder with the different blade edge grinding member.

13. The method of claim 11, further comprising removing the knife held to the magnetic knife holder, adjusting a sharpening angle of the adjustable angle assembly appropriate to the blade of a different knife; magnetically holding the blade of the different knife with the adjustable angle assembly.

14. The method of claim 13, further comprising adjusting a height of the adjustable height assembly appropriate to the blade of the different knife; magnetically holding the blade edge grinding member with the adjustable height assembly; sharpening the edge of the blade of the different knife held to the magnetic knife holder with the blade edge grinding member by rolling the adjustable roller sharpener with grinding member back and forth on a support surface.

* * * * *